US008444251B2

(12) United States Patent
Heo et al.

(10) Patent No.: US 8,444,251 B2
(45) Date of Patent: May 21, 2013

(54) SCRAPPING UNIT AND IMAGE FORMING APPARATUS HAVING THE SAME, AND CLEANING METHODS THEREOF

(75) Inventors: Gun Heo, Yongin-si (KR); Karp-sik Youn, Hwaseong-si (KR); Young-su Lee, Suwon-si (KR); Youn-gun Jung, Yongin-si (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 306 days.

(21) Appl. No.: 12/785,738

(22) Filed: May 24, 2010

(65) Prior Publication Data

US 2011/0043568 A1 Feb. 24, 2011

(30) Foreign Application Priority Data

Aug. 24, 2009 (KR) ..... 10-2009-0077999

(51) Int. Cl.
*B41J 2/165* (2006.01)

(52) U.S. Cl.
USPC ..... 347/33; 347/22; 347/34; 347/32

(58) Field of Classification Search
USPC ..... 347/33, 22, 34, 32
See application file for complete search history.

(56) References Cited

U.S. PATENT DOCUMENTS 5,914,734 A * 6/1999 Rotering et al. ..... 347/28
5,969,731 A 10/1999 Michael et al.
6,692,100 B2 * 2/2004 Steinfield et al. ..... 347/22

FOREIGN PATENT DOCUMENTS

JP 2003-211683 7/2003
JP 2007-44975 2/2007

* cited by examiner

*Primary Examiner* — Matthew Luu
*Assistant Examiner* — Henok Legesse
(74) *Attorney, Agent, or Firm* — Stanzione & Kim, LLP

(57) ABSTRACT

A scrapping unit and an image forming apparatus having the same, and cleaning methods thereof to improve a maintenance performance. The scrapping unit cleans a polluted member disposed in an image forming apparatus and stained by a polluting material. The scrapping unit may include an endless belt to circulate between an exposed position where a surface of the endless belt is exposed toward the polluted member, and a non-exposed position where the surface of the endless belt is not exposed with respect to the polluted member, and a belt support frame which includes a belt support surface to support the endless belt so that the endless belt can be unfolded in the exposed position, and a storing space to store the endless belt so that the endless belt can be folded in the non-exposed position.

17 Claims, 23 Drawing Sheets

SCRAPPING UNIT AND IMAGE FORMING APPARATUS HAVING THE SAME, AND CLEANING METHODS THEREOF

CROSS-REFERENCE TO RELATED APPLICATIONS

This application claims priority under 35 U.S.C. §119(a) from Korean Patent Application No. 10-2009-0077999, filed on Aug. 24, 2009 in the Korean Intellectual Property Office, the disclosure of which is incorporated herein in its entirety by reference.

BACKGROUND

1. Field of the Invention

The present general inventive concept relates to a scrapping unit and an image forming apparatus having the same, and, more particularly, to a scrapping unit and an image forming apparatus having the same to improve a maintenance performance.

2. Description of the Related Art

An image forming apparatus is an apparatus to print an image on a printing medium, and is classified depending on a printing type into an inkjet type discharging an ink through a nozzle, an electrophotographic type printing with a toner through a series of processes which are charging, exposing, developing, transferring, fusing and cleaning, a thermal transfer type using a thermal head, etc.

An inkjet printer includes a printing head formed with the nozzle. The nozzle of an ink discharging surface of the printing head is blocked when the ink discharging surface is polluted by a foreign substance. Accordingly, a wiping operation that wipes the ink discharging surface with a wiper member is performed to prevent a nozzle from blocking and to remove a foreign substance attached to the ink discharging surface.

Also, after performing the wiping operation, the wiper member is stained with a scrapped ink, and a scrapping operation of wiping the scrapped ink remaining in the wiper member with a scrapped ink absorbing member is performed under a predetermined condition (for example, a uniform period, etc.).

However, if the scrapping operation is repeated for a long time, the scrap ink absorbing member is polluted. Accordingly, the scrap ink of the wiper member fails to be removed, and the wiper member may be further polluted by the polluted absorbing member.

Also, it is necessary to frequently replace the polluted scrapped ink absorbing member. As such, maintenance costs increases and maintenance efficiency decreases.

With an array-type printing head that extends in a widthwise direction of a printing medium that prints a line all at once, since the printing head is fixedly disposed inside a printer and it is difficult to replace the printing head, it is important to maintain the head through the wiping operation and the scrapping operation.

SUMMARY

Accordingly, exemplary embodiments of the present general inventive concept provide a scrapping unit and an image forming apparatus having the same to reduce maintenance costs and to minimize and/or avoid increasing the size of the image forming apparatus. Exemplary embodiments of the present general inventive concept also maintain the printing head of an image forming apparatus through a wiping operation and a scrapping operation.

Additional features and utilities of the present general inventive concept will be set forth in part in the description which follows and, in part, will be obvious from the description, or may be learned by practice of the general inventive concept.

Exemplary embodiments of the present general inventive concept also provide a scrapping unit and an image forming apparatus having the same improving a maintenance performance.

Exemplary embodiments of the present general inventive concept also provide a scrapping unit and an image forming apparatus having the same reducing the size of a product.

The foregoing and/or other features and utilities of the present general inventive concept are achieved by providing a scrapping unit to clean a polluted member disposed in an image forming apparatus and stained by a polluting material, the scrapping unit including an endless belt which circulates between an exposed position where a surface of the endless belt is exposed toward the polluted member, and a non-exposed position where the surface of the endless belt is not exposed with respect to the polluted member, and a belt support frame which includes a belt support surface to support the endless belt so that the endless belt can be unfolded in the exposed position, and a storing space to store the endless belt so that the endless belt can be folded in the non-exposed position.

The belt support frame may include an entrance hole through which the endless belt flows toward the storing space from the belt support surface, and a discharging hole through which the endless belt flows toward the belt support surface from the storing space.

The belt support frame may include a belt tension applying unit to apply a tension to the endless belt so that the endless belt is exposed as substantially flat toward the belt support surface from the storing space.

The belt tension applying unit may support the endless belt so that a movement path of the endless belt can be a zigzag movement path.

The scrapping unit may further include a driven roller which is disposed in the belt support frame, a driving roller which is disposed in the belt support frame, and is engaged with the driven roller to interpose the endless belt therebetween, and a driving pinion which is disposed to be exposed outside the belt support frame to drive the driving roller.

Exemplary embodiments of the present general inventive concept also provide an image forming apparatus, including an image forming unit which forms an image to a printing medium, a polluted member which is disposed in the image forming apparatus, and is stained by a polluting material, and a scrapping unit to clean the polluted member.

The scrapping unit may include an endless belt which circulates between an exposed position where a surface of the endless belt is exposed toward the polluted member, and a non-exposed position where the surface of the endless belt is not exposed with respect to the polluted member, and a belt support frame which includes a belt support surface to support the endless belt so that the endless belt can be unfolded in the exposed position, and a storing space to store the endless belt so that the endless belt can be folded in the non-exposed position.

The belt support frame may include an entrance hole through which the endless belt flows toward the storing space from the belt support surface.

The belt support frame may include a discharging hole through which the endless belt flows toward the belt support surface from the storing space.

The belt support frame may further include a belt tension applying unit to apply a tension to the endless belt so that the endless belt can be exposed as substantially flat toward the belt support surface from the storing space.

The belt tension applying unit may support the endless belt so that a movement path of the endless belt can be a zigzag movement path.

The image forming unit may include an array head unit which is disposed with a plurality of head chips that have a length to correspond to a widthwise direction of a printing medium, and discharges an ink.

The polluted member may include a plurality of wiper members which are disposed along the widthwise direction of the printing medium to wipe an ink discharging surface of the array head unit.

The image forming apparatus may further include a wiping unit which includes a support member to support the plurality of wiper members, and moves up and down between an approaching position approaching the array head unit and a first retreating position retreating from the approaching position.

The image forming apparatus may further include a widthwise direction driving unit to move the wiping unit in the widthwise direction of the printing medium so that the plurality of wiper members can move in the widthwise direction of the printing medium.

The image forming apparatus may further include a wiper elevating unit to elevate the wiping unit between the approaching position and the first retreating position.

The wiping unit may include a wiper frame to support the support member, a guide protrusion which is formed to one of the wiper frame and the support member, and a guide groove which is formed to the other of the wiper frame and the support member, and interlocks with the guide protrusion so that the plurality of wiper members can move upwardly from the approaching position to a contact position to contact an ink discharging surface of the array head unit when the support member moves in the widthwise direction of the printing medium.

The image forming apparatus may further include a control unit to control the widthwise direction driving unit and the wiper elevating unit so that the plurality of wiper members can move to the approaching position and the contact position, and can move in the widthwise direction of the printing medium and contact the ink discharging surface of the array head unit when there is a wiping signal received by the control unit.

The scrapping unit may move between a cleaning position to clean the polluted member, and a second retreating position to retreat from the cleaning position.

The image forming apparatus may further include a scrapping unit driving unit to move the scrapping unit between the cleaning position and the second retreating position.

The image forming apparatus may further include a control unit to control the scrapping unit driving unit so that the scrapping unit can move to the cleaning position, and to control the wiper elevating unit and the widthwise direction driving unit so that the plurality of wiper members can move in the widthwise direction of the printing medium and contact the endless belt of the scrapping unit when there is a wiper cleaning signal.

The endless belt of the scrapping unit may be driven to interlock with a movement in the widthwise direction of the printing medium of the polluted member.

The scrapping unit may further include a driven roller disposed in the belt support frame, a driving roller disposed in the belt support frame and engaged with the driven roller to interpose the endless belt therebetween, and an endless belt driving pinion disposed to be exposed outside the belt support frame to drive the driving roller.

The image forming apparatus may further include a support member to support the polluted member, and a wiper rack which is disposed to the support member to rotate the endless belt driving pinion when the support member moves in the widthwise direction.

Exemplary embodiments of the present general inventive concept also provide a method of cleaning a polluted member disposed in an image forming apparatus and stained by a polluting material with a scrapping unit, the method including moving a belt of the scrapping unit between an exposed position where a surface of the belt is exposed toward the polluted member, and a non-exposed position, and supporting the belt with a belt support frame having a belt support surface so that the belt is unfolded in the exposed position, and storing the belt so that the belt is folded in the non-exposed position.

The method may also include applying a tension to the belt with a belt tension applying unit to expose the belt as substantially flat toward the belt support surface from the storing space.

The method may also include moving the belt in a zigzag movement path by supporting the belt with the belt tension applying unit.

The method may also include moving a plurality of wiper members which are disposed along a widthwise direction of a printing medium and wiping an ink discharging surface of an array head unit of the image forming apparatus.

The method may also include moving a wiping unit between an approaching position approaching the array head unit and a first retreating position retreating from the approaching position, moving the wiping unit in the widthwise direction of the printing medium with a widthwise direction driving unit so that the plurality of wiper members move in the widthwise direction of the printing medium, and elevating the wiping unit between the approaching position and the first retreating position with a wiper elevating unit.

The method may also include interlocking a guide groove which is formed to one of a wiper frame and a support member with a guide protrusion so that the plurality of wiper members move upwardly from the approaching position to a contact position contacting to an ink discharging surface of the array head unit when the support member moves in the widthwise direction of the printing medium.

The method may also include controlling the movement the plurality of wiping members with a control unit and contacting the ink discharging surface of the array head unit with the plurality of wiping members when a wiping signal is received by a control unit.

The method may also include moving the scrapping unit between a cleaning position to clean the polluted member and a second retreating position that retreats from the cleaning position with a scrapping unit driving unit.

The method may also include controlling a scrapping unit driving unit with a control unit so that the scrapping unit moves to the cleaning position, and controlling a wiper elevating unit and a widthwise direction driving unit so that the plurality of wiper members move in the widthwise direction of the printing medium and contact the endless belt of the scrapping unit when a wiper cleaning signal is received by the control unit.

The method may also include driving the belt of the scrapping unit to interlock with a movement in the widthwise direction of the printing medium of the polluted member.

BRIEF DESCRIPTION OF THE DRAWINGS

The present general inventive concept will become apparent and more readily appreciated from the following description of the exemplary embodiments, taken in conjunction with the accompanying drawings, in which.

DETAILED DESCRIPTION OF THE EMBODIMENTS

Figure 1:
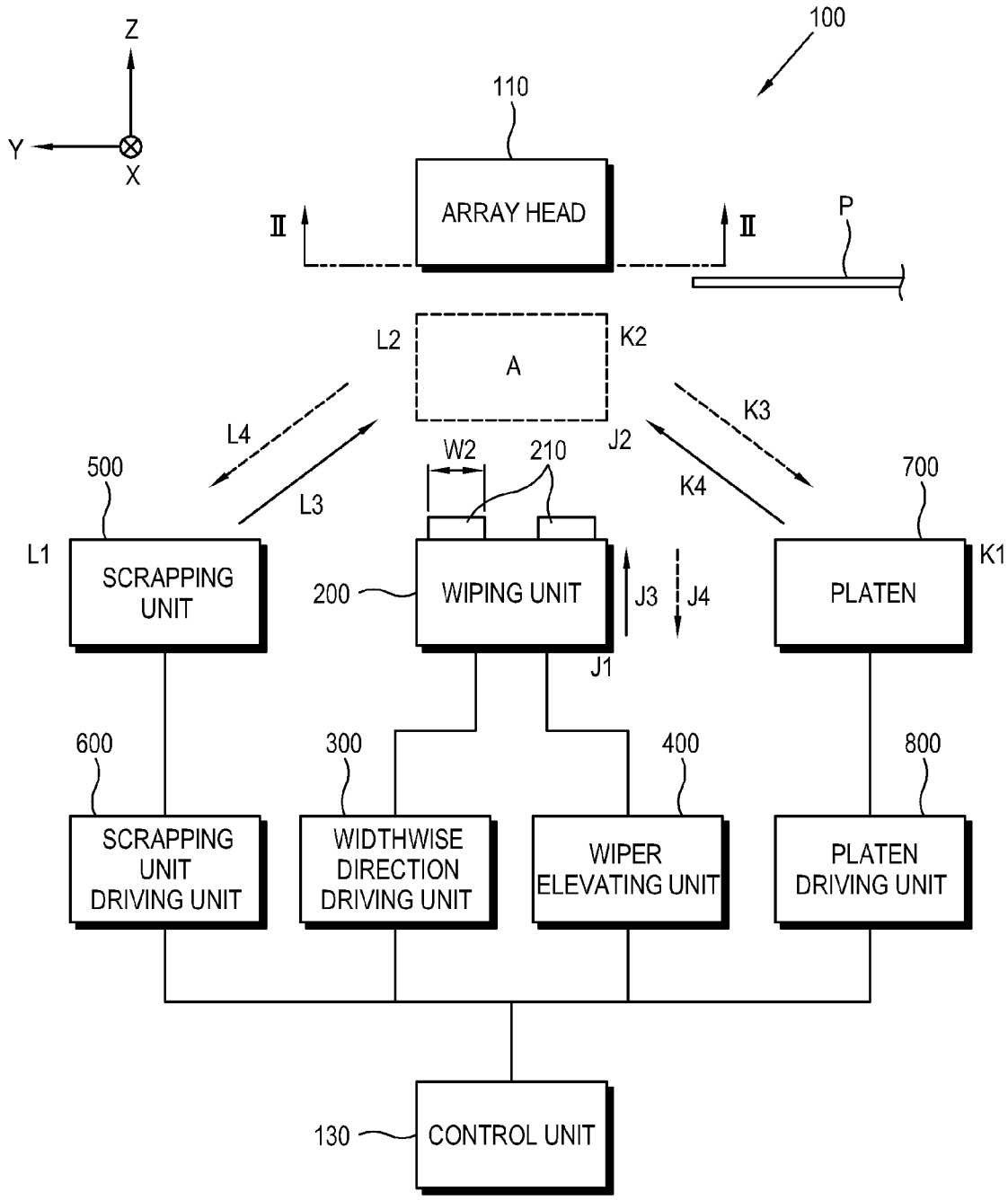
FIG. 1 is a schematic block diagram illustrating an inkjet printer according to exemplary embodiments of the present general inventive concept.

Reference will now be made in detail to the embodiments of the present general inventive concept, examples of which are illustrated in the accompanying drawings, wherein like reference numerals refer to like elements throughout. The exemplary embodiments are described below so as to explain the present general inventive concept by referring to the figures. Repetitive description with respect to like elements of different embodiments may be omitted for the convenience of clarity. Hereinafter, an inkjet printer 100 will be described as an exemplary image forming apparatus.

Figure 2:
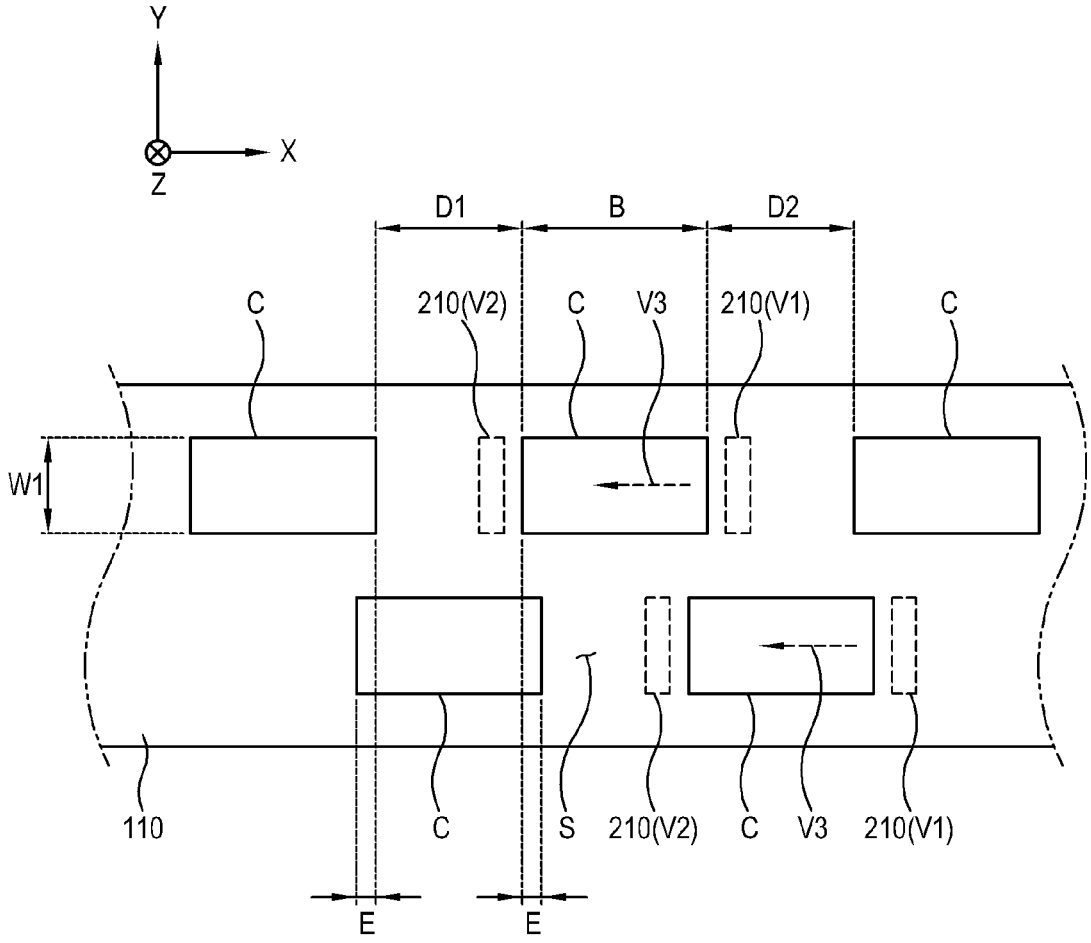
FIG. 2 illustrates an enlarged main portion view of an array head unit of the inkjet printer in FIG. 1 in line II in FIG. 1.

As illustrated in FIGS. 1 and 2, the inkjet printer 100 according to the present general inventive concept includes an array head unit 110 disposed with a plurality of head chips C to have a length B corresponding to a widthwise direction X of a printing medium P, a wiping unit 200 wiping an ink discharging surface S of the array head unit 110, a widthwise direction driving unit 300 reciprocating the wiping unit 200 in the widthwise direction X of the printing medium P, a wiper elevating unit 400 elevating the wiping unit 200 between an approaching position approaching the array head unit 110 and a first retreating position retreating from the approaching position, a scrapping unit 500, and a scrapping unit driving unit 600 driving the scrapping unit 500.

As illustrated in FIG. 2, in the array head unit 110, the plurality of head chips C can be disposed along the widthwise direction X of the printing medium P to be distanced by a predetermined interval D1 and D2. The plurality of head chips C can be disposed in two rows along a lengthwise direction Y of the printing medium P, and may be disposed in a zigzag arrangement so that at least one nozzle (not illustrated) of an end side of the head chip C of each row can be overlapped by a predetermined interval E.

The array head unit 110 may discharge an ink onto the printing medium P to form an image. The array head unit 110 may be referred to as an image forming unit. If the image forming apparatus is an electrophotographic type image forming apparatus rather than the inkjet printer 100 illustrated in FIG. 1, the image forming unit may include, for example, an image carrying body (not illustrated), a surface of which is formed with an electrostatic latent image, a developing unit (not illustrated) to develop the electrostatic latent image of the image carrying body with a toner, a transferring unit (not illustrated) to transfer the developed toner to a printing medium, and a fusing unit (not illustrated) to fuse the toner transferred to the printing medium with heat and pressure. If the image forming apparatus is a thermal transfer type image forming apparatus rather than the inkjet printer 100 illustrated in FIG. 1, the image forming unit may include, for example, a thermal printing head (TPH).

The wiping unit 200 and the scrapping unit 500 may be selectively disposed to area A of the array head unit 110. That is, the wiping unit 200 may move from a first retreating position J1 to an approaching position J2 in area A by moving direction J3, or from the approaching position J2 in area A to the first retreating position J1 by moving in direction J4. Scraping unit 500 may be moved in direction L3 from a second retreating position L1 to a cleaning position L2 in area A by moving in direction L3, and move from the cleaning position L2 to the second retreating position L1 by moving in direction L4. A platen 700 may be selectively disposed to the area A of the array head unit 110. That is, the platen 700 may be moved from a fourth retreating position K1 to a support position K2 in area A by moving in direction K4, and from the support position K2 in direction K4 so as to be positioned in area A, and may be moved from the support position K2 in direction K3 to the fourth resting position K1.

The wiping unit 200 may move (e.g., up and down) between an approaching position J2 that approaches the array head unit 110, and a first retreating position J1 that retreats from the approaching position J2.

The wiping unit 200 may move in direction J3 (i.e., along a solid line arrow J3 illustrated in FIG. 1) from the first retreating position J1 toward the approaching position J2 to perform a wiping operation of the ink discharging surface S of the array head unit 110. The wiping unit 200 may move in direction J4 (i.e., along a dotted line arrow J4) from the approaching position J2 toward the first retreating position J1 when the wiping operation is completed.

Figure 3:
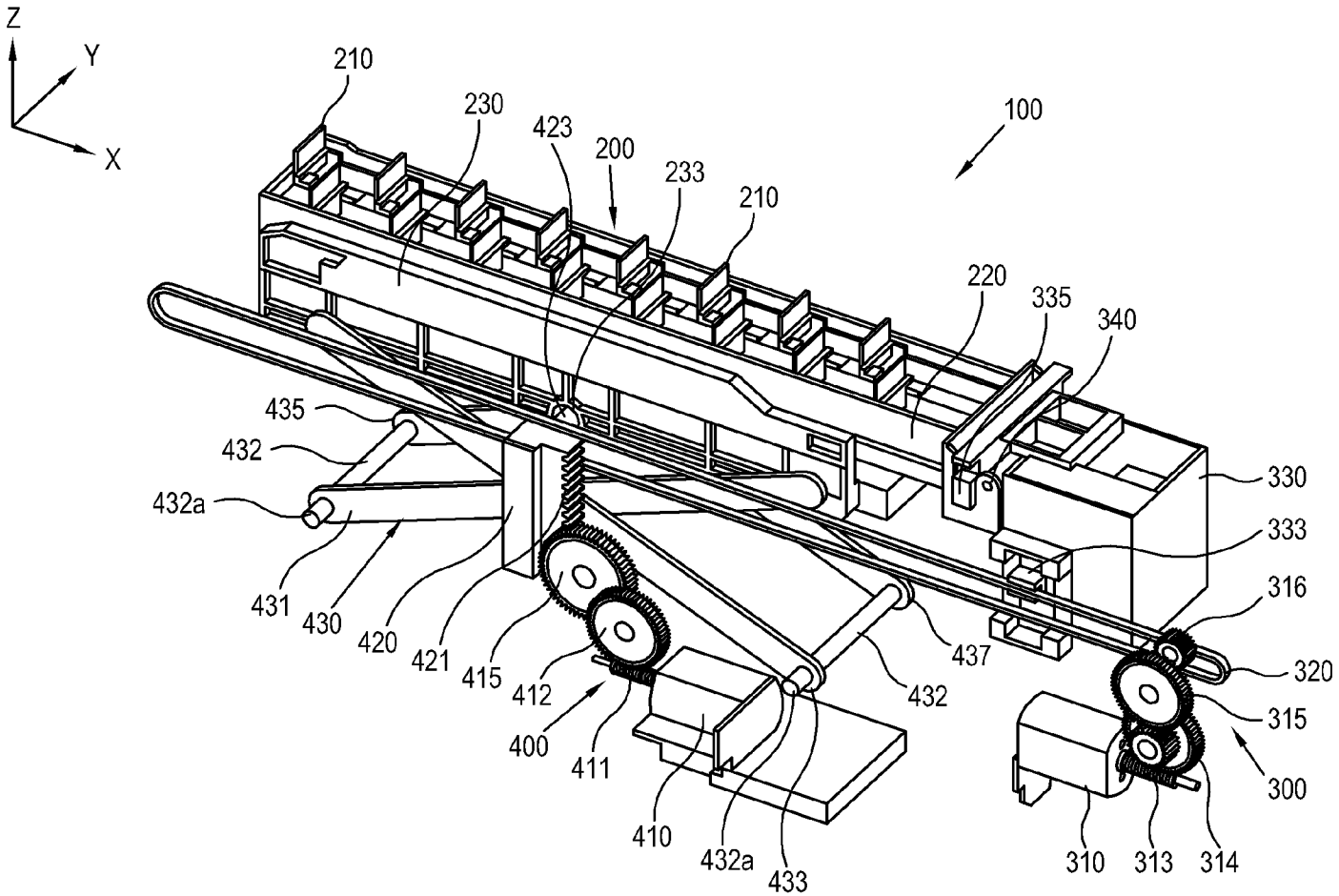
FIG. 3 illustrates an enlarged main portion perspective view of the inkjet printer in FIG. 1.
Figure 4:
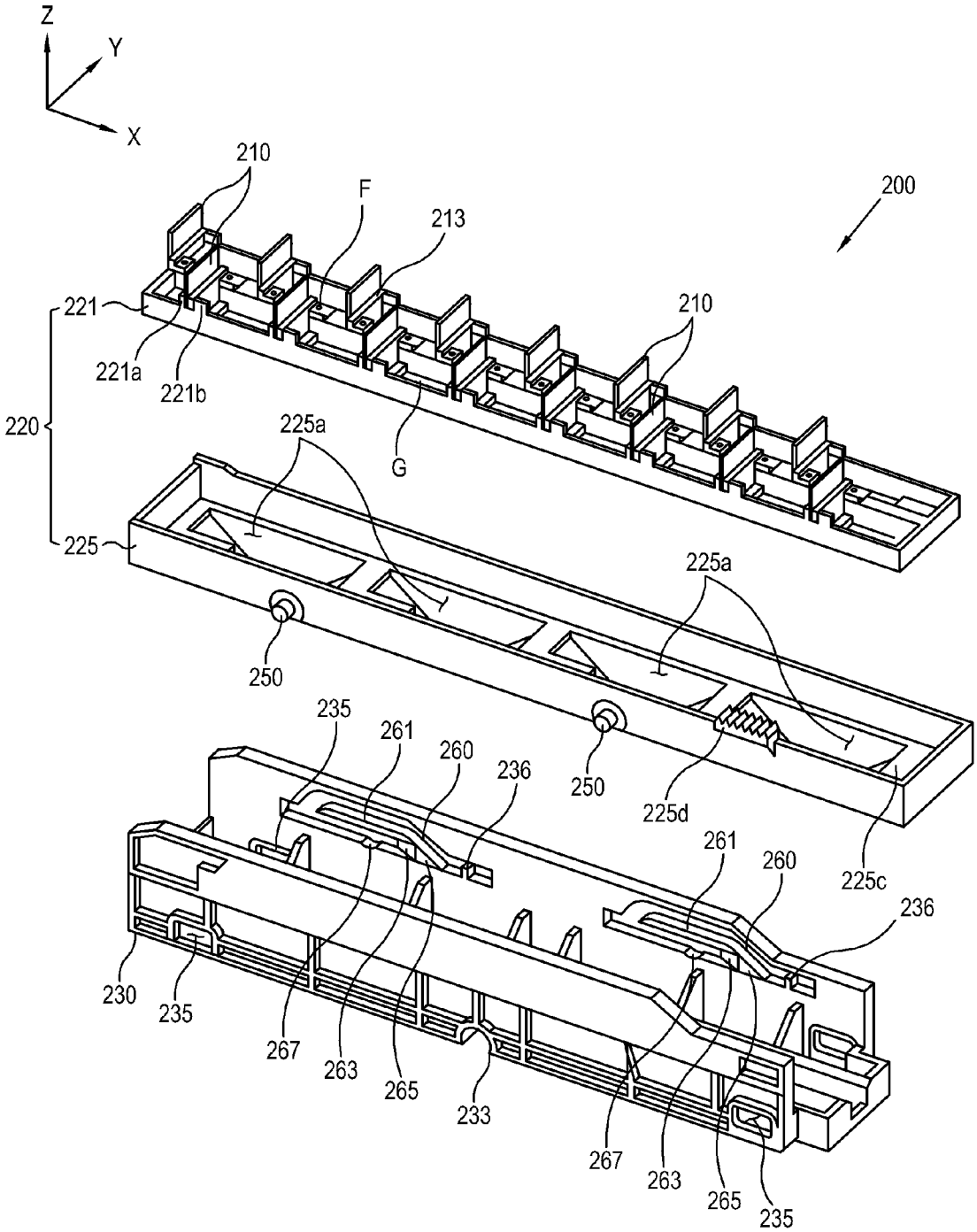
FIG. 4 is an exploded perspective view illustrating a wiping unit of the inkjet printer in FIG. 1.

As illustrated in FIGS. 3 and 4, the wiping unit 200 can include a plurality of wiper members 210 disposed along the widthwise direction X of the printing medium P, and a support member 220 to support the plurality of wiper members 210.

One or more of the plurality of wiper members 210 may be provided for each head chip C of the plurality of head chips C of the array head unit 110. Accordingly, one wiper member 210 may clean one head chip C corresponding thereto.

A pollution material such as a scrapped ink or a foreign material may be adhered to an outer surface of the wiper member 210. That is, the wiper member 210 may be referred to as a pollution member stained with the pollution material. The pollution material may also include, for example, a scrapped toner, and the pollution member may include a cleaning blade to clean the scrapped toner remaining on a surface of the image carrying body after transferring. There may be one or more pollution members to be cleaned in an image forming apparatus, of which one or more may be selectively cleaned.

The width W2 illustrated in FIG. 1 in the widthwise direction Y of the printing medium P of the plurality of wiper members 210 may respectively be equal to, about equal to, or more than the width W1 in FIG. 2 in the lengthwise direction Y of the printing medium P of the head chip C. Accordingly, if the wiper member 210 moves in the widthwise direction X of the printing medium P, the head chip C can be wiped. The width W2 of the wiper member 210 may cover the width W1 of the head chip C.

The plurality of wiper members 210 may be attached to a coupling piece 213, and the coupling piece 213 may be detachably coupled to the support member 220 by a coupling means F. Accordingly, even if there is a defect to a part of the plurality of wiper members 210, it can be easily replaced. One or more of the plurality of wiper members 210 may be directly coupled to the support member 220 without the coupling piece 213.

The support member 220 may include a first support member 221 coupled to the plurality of wiper members 210, and a second support member 225 coupled with the first support member 221 by a coupling means (not illustrated). In exemplary embodiments of the present general inventive concept, the first and second support members 221 and 225 may be integrally formed.

As illustrated in FIG. 4, the first support member 221 may include insertion protrusions 221*a* and 221*b* in which the wiper member 210 and the coupling piece 213 are inserted such that the wiper members 210 and the coupling piece 213 are coupled. The insertion protrusions 221*a* and 221*b* may be provided in pairs for each of the plurality of wiper members 210.

Figure 6:
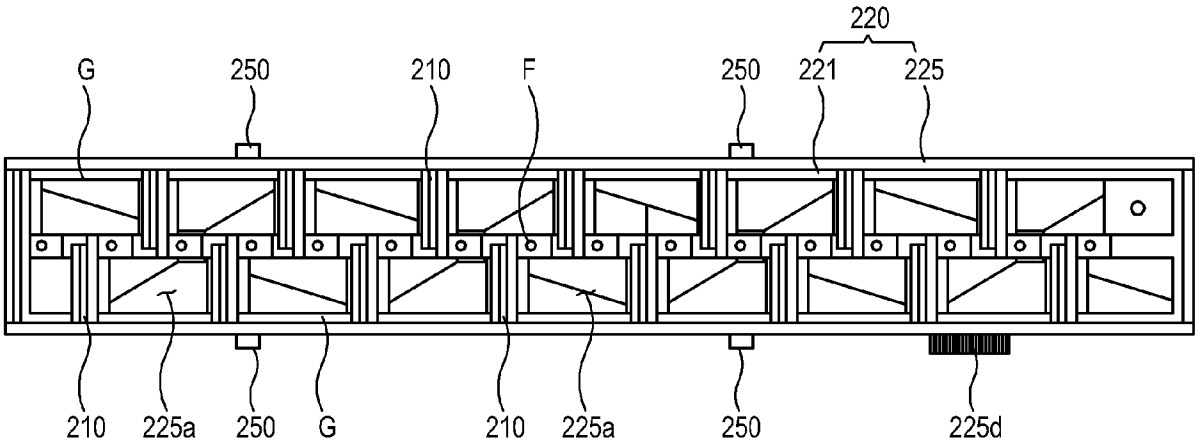
FIG. 6 is an enlarged plain view illustrating a wiper member and a support member of the wiping unit in FIG. 4.

As illustrated in FIGS. 4 and 6, the first support member 221 may be formed with an entry hole F and a transmission hole G through which a scrapped ink is discharged during a spitting process to discharge an ink outside through the nozzle of the head chip C to remove a foreign material which may exist in the nozzle. That is, scrapped ink is received by the entry hole F and is transmitted through the transmission hole G, and is discharged during the spitting process.

Figure 7:
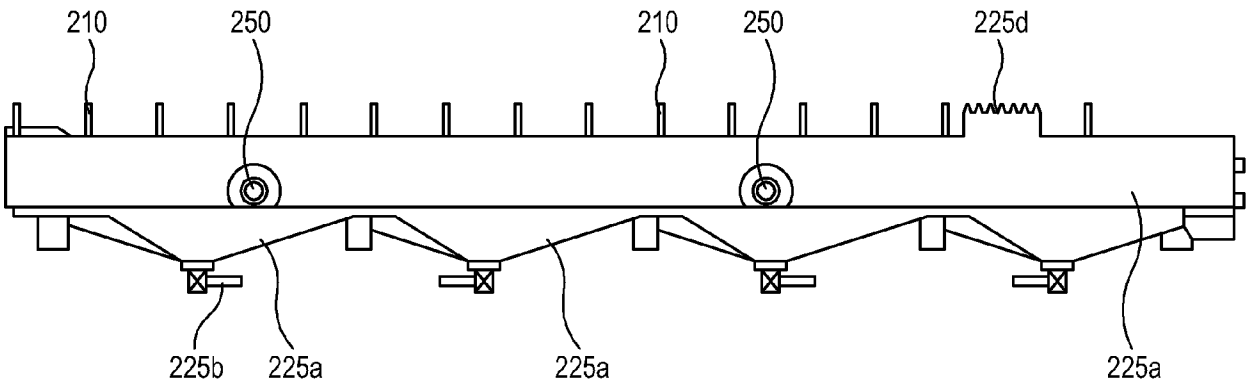
FIG. 7 is an enlarged side view illustrating the support member of the wiping unit in FIG. 4.

As illustrated in FIGS. 4, 6 and 7, the second support member 225 can include a seating surface 225*c* in which the first support member 221 is seated, a scrapped ink accommodating unit 225*a* to accommodate a scrapped ink discharged during the spitting process, and a discharging hole 225*b* to discharge the scrapped ink of the scrapped ink accommodating unit 225*a* outside.

An ink discharged from the nozzle of the head chip C during the spitting process may be received by entry hole F, transmitted through the transmission hole G, and be received by and/or accommodated in the scrapped ink accommodating unit 225*a*.

As illustrated in FIG. 7, the scrapped ink accommodating unit 225*a* may have an inclined shape toward the scrapped ink discharging hole 225*b* so that the scrapped ink received by entry hole F, and that is transmitted through the transmission hole G can be gathered toward the scrapped ink discharging hole 225*b*.

Figure 13:
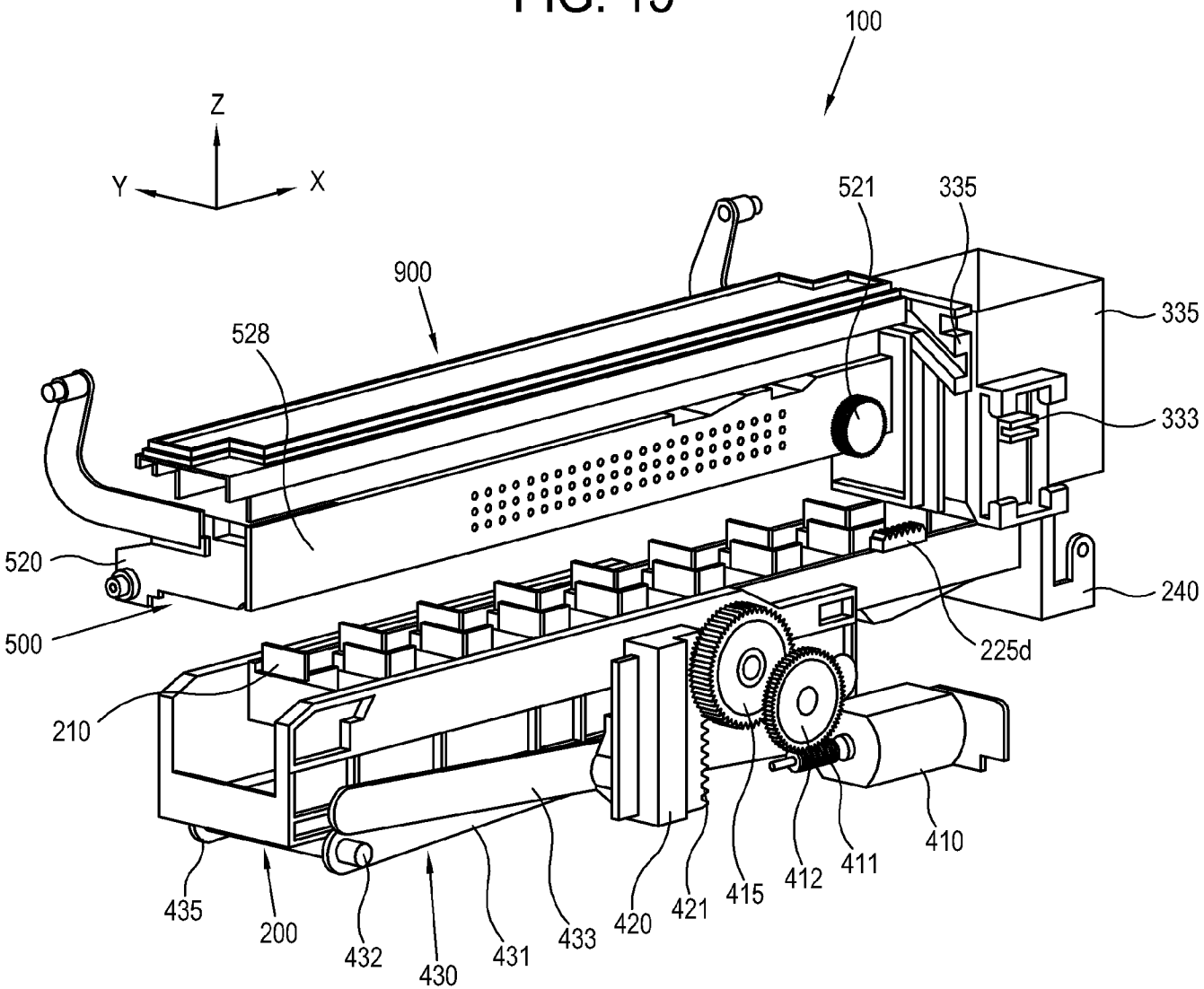
FIG. 13 is an enlarged main portion perspective view illustrating a state in which a scrapping unit of the inkjet unit in FIG. 1 is moved to a cleaning position.

At least one of the second support member 225 and the first support member 221 may include a wiper rack 225*d* engaged with an endless belt driving pinion 521 in FIG. 13 of the scrapping unit 500. As the endless belt driving pinion 521 in FIG. 13 and the wiper rack 225*d* may interact each other, an endless belt 510 in FIG. 14 of the scrapping unit 500 circulates to interlock with a movement in the widthwise direction X of the printing medium P of the support member 220. A driving mechanism thereabout will be described in detail below.

The wiping unit 200 may include a wiper frame 230 to support the support member 220, a guide protrusion 250 formed to the second support member 225, and a guide groove 260 formed to the wiper frame 230.

The guide protrusion 250 may be provided in pairs on each of the opposite sides of the second support member 225. That is, there may be two guide protrusions 250 on a first side of the second support member 225, and two guide protrusions 250 on a second side (i.e., that is opposite the first side) of the second support member 225. However, the number of guide protrusions 250 may be appropriately increased or decreased, and may be suitably positioned adjacent to the second support member 225. The guide protrusion 250 may be formed in a distanced position along the widthwise direction X of the printing medium to a side of the second support member 225.

Figure 5:
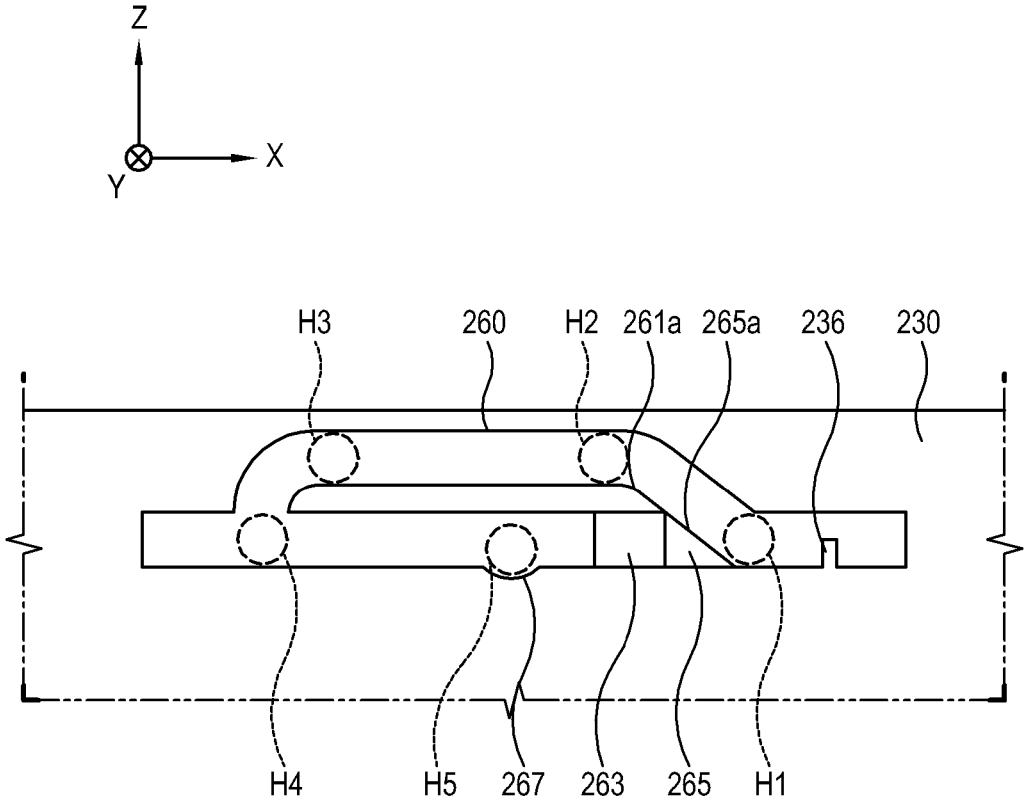
FIG. 5 is an enlarged side view illustrating a position relation of a guide groove and a guide protrusion of the wiping unit in FIG. 4.

As illustrated in FIGS. 4 and 5, the guide groove 260 is provided so that the guide protrusion 250 can return to an original standby position H5 via a first position H1, a second position H2, a third position H3 and a fourth position H4 from the standby position H5. A concave groove 267 may be formed along a downward direction (the opposite direction to Z) so that the guide protrusion 250 can be further stably positioned in the standby position H5. In exemplary embodiments of the present general inventive concept, the standby position H5 may be omitted, and the first position H1 or the fourth position H4 may be provided as a standby position.

If the guide protrusion 250 performs one or more processes from the standby position H5 to the standby position H5 again via the first to fourth positions H1, H2, H3 and H4, the plurality of wiper members 210 may perform a wiping operation to wipe the ink discharging surface S of the array head unit 110. A process of the wiping operation that depends on interaction of the guide protrusion 250 and the guide groove 260 will be described in detail below.

The guide protrusion 250 may move from the standby position H5 to the first position H1 by being shifted in the lengthwise direction Y of the printing medium along an inclined surface 263 inclined in the lengthwise direction Y of the printing medium to transmit through a second protrusion 265.

The guide groove 260 can include a first protrusion 261, the second protrusion 265, and a third protrusion 236 to form the first to fourth positions H1, H2, H3 and H4. The guide protrusion 250 can move from the first position H1 to the second position H2 along each inclined surface 261*a* and 265*a* of the first protrusion 261 and the second protrusion 265. The third protrusion 236 may direct the guide protrusion 250 from the first position H1 to the second position H2.

A moving direction from the second position H2 to the third position H3 of the guide protrusion 260 may be parallel or substantially parallel with the widthwise direction X of the printing medium P.

The distance between the second position H2 and the third position H3 may be equal to or greater than the length in the widthwise direction X of the head chip C (e.g., equal to or greater than the length B of head chip C illustrated in FIG. 2). Accordingly, at least a portion of a surface of the head chip C or a total surface of the head chip C can be wiped by the corresponding wiper member 210.

A movement from the third position H3 to the fourth position H4 of the guide protrusion 260 can occur as the guide protrusion 260 contacts to a downwardly inclined surface of the first protrusion 261.

The guide protrusion 250 can move from the fourth position H4 to the standby position H5 along the guide groove 260.

As the guide protrusion 250 is inserted to the guide groove 260, the support member 220 may move in the widthwise direction X of the printing medium with respect to the wiper frame 230.

In exemplary embodiments of the present general inventive concept, the guide protrusion 250 may be formed to the first support member 221 instead of the second support member 225, and may be formed to all of the first and second support members 221 and 225.

The guide protrusion 250 and the guide groove 260 may be provided to an inner surface of the wiper frame 230 and an outer surface of the second support member 225 in exemplary embodiments of the present general inventive concept.

The wiper frame 230 may include an elevating rack protrusion insertion unit 233 in which an elevating rack protrusion 423 of an elevating rack 420 is inserted, and a connecting rod insertion hole 235 through which a connecting rod 432 is inserted.

The elevating rack protrusion insertion unit 233 may be provided to a middle part of the length in the widthwise direction X of the printing medium of the wiper frame 230. As illustrated in FIG. 4 and described above, a side of the elevating rack protrusion insertion unit 233 is described to be opened, but may be provided to be closed.

The connecting rod insertion hole 235 may be provided in an elongated hole along the widthwise direction X of the printing medium.

The widthwise direction driving unit 300 may reciprocate the support member 220 of the wiping unit 200 along the widthwise direction X of the printing medium P.

Figure 8:
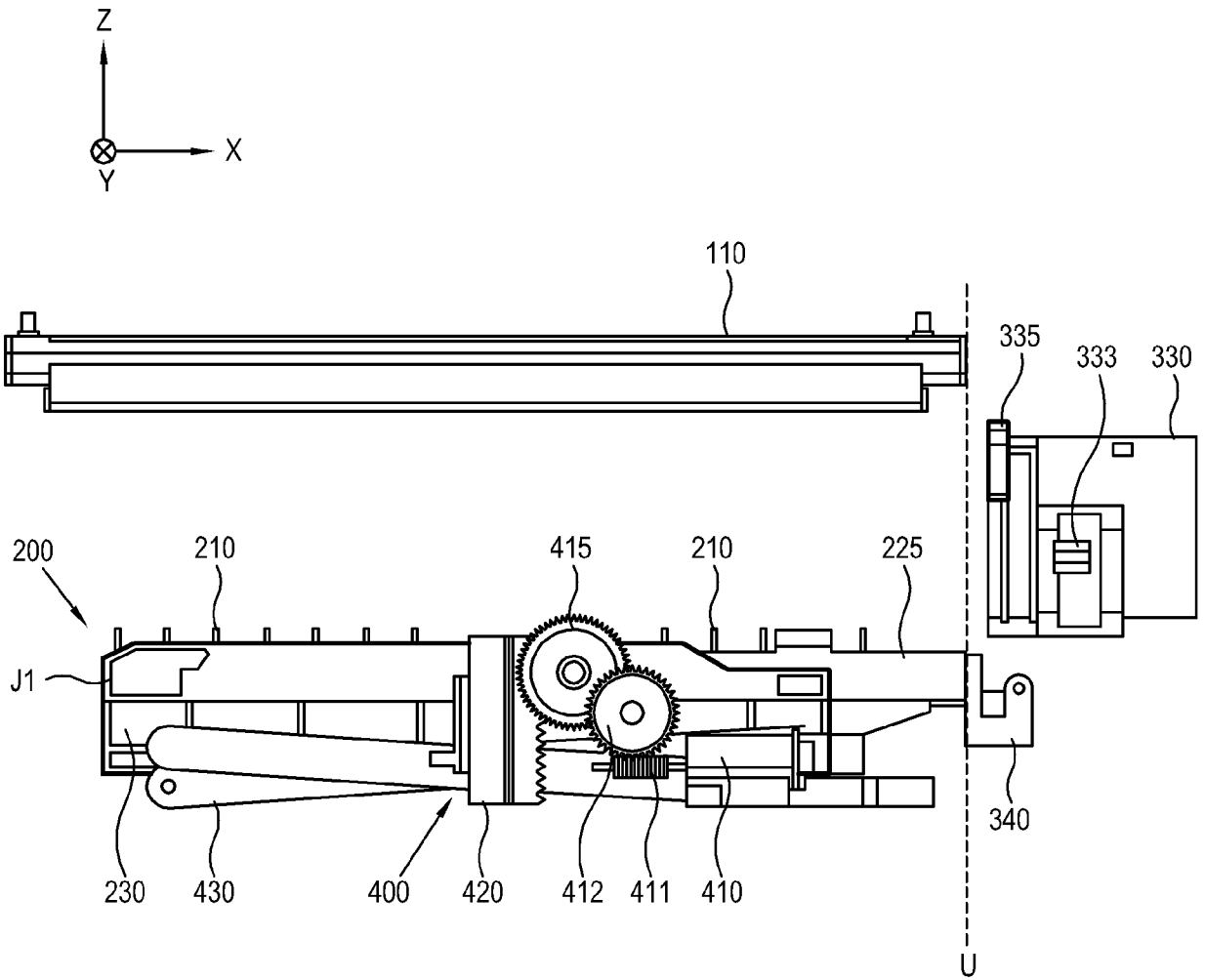
FIGS. 8 to 12 illustrate processes of a wiping operation of the inkjet printer in FIG. 1 according to exemplary embodiments of the present general inventive concept.

As illustrated in FIGS. 3 and 8, the widthwise direction driving unit 300 can include a shuttle 330 with a first engagement unit 335 to reciprocate in the widthwise direction X of the printing medium, and a second engagement unit 340 disposed adjacent to the support member 220 and engaged with the first engagement unit 335 when the wiping unit 200 moves upwardly by the wiper elevating unit 400.

The widthwise direction driving unit 300 may further include a driving belt 320 to circulate along the widthwise direction X of the printing medium P, a width direction driving source 310 driving the driving belt 320, and a clamper 333 disposed on a surface of the shuttle 330 to clamp the driving belt 320.

A worm gear 313 is disposed on a surface of a driving shaft of the widthwise direction driving source 310, and a driving force of the worm gear 313 is transmitted to a driving pulley 316 to drive the driving belt 320 via relaying gears 314 and 315.

As illustrated in FIG. 3, the wiper elevating unit 400 can include the elevating rack 420 having the elevating rack protrusion 423 inserted to the elevating rack protrusion insertion unit 233 of the wiper frame 230, an elevating driving source 410 to generate a driving force for moving the elevating rack 420 along an upward and downward direction Z, and a fold unit 430 to support the wiping unit 200 and unfolded when the wiping unit 200 moves upwardly and folded when the wiping unit 200 moves downwardly.

The driving force of the worm gear 411 disposed on the surface of the driving shaft of the elevating driving source 410 can be transmitted to a pinion (not illustrated) through relaying gears 412 and 415. The pinion can be disposed coaxially with the relaying gear 415 to be engaged by rack teeth 421 of the elevating rack 420.

The elevating rack 420 can move upwardly and downwardly in the upward and downward direction Z according to a rotation direction of the pinion. As the elevating rack 420 elevates in the upward and downward direction (i.e., the Z direction), the wiping unit 200 to which the elevating rack 420 is connected elevates upwardly and downwardly together with the elevating rack 420.

If the elevating rack protrusion insertion unit 233 of the wiper frame 230 is opened downwardly as illustrated in FIG. 4, as the elevating rack 420 may not move the wiping unit 200 when the elevating rack 420 moves downwardly, the elevating rack 420 may be connected to the fold unit 430 so that the fold unit 430 is interlocked with an upward and downward movement of the elevating rack 420 to be unfolded and folded.

The fold unit 430 can include first and second cross bars 431 and 433 crossing each other in an X shape in a side of the wiper frame 230, third and fourth cross bars 435 and 437 crossing each other in an X shape in the other side of the wiper frame 230, and a plurality of connecting rods 432 respectively connecting the opposite end parts of the first cross bar 431 and the third cross bar 435 and the opposite end parts of the second cross bar 433 and the fourth cross bar 437.

A protruding unit 432*a* of a lower connecting rod 432 among the plurality of connecting rods 432 can be supported by a printer main body (not illustrated) formed with an elongated hole (not illustrated) elongated along the widthwise direction X of the printing medium. That is, the protruding unit 432*a* can be inserted to the elongated hole. Accordingly, a movement in the upward and downward direction Z of the protruding unit 432*a* may be regulated, and a movement in the widthwise direction X of the printing medium thereof may be defined by the length of the elongated hole.

An upper connecting rod 432 of among the plurality of connecting rods 432 may be inserted through the connecting rod insertion hole 235 of the wiper frame 230, and the connecting rod insertion hole 235 may be provided as an elongated hole along the widthwise direction X of the printing medium P, as described above.

As illustrated in FIG. 1, the scrapping unit 500 may move between a cleaning position L2 to clean the plurality of wiper members 210 and a second retreating position L1 to retreat from the cleaning position L2.

Figure 14:
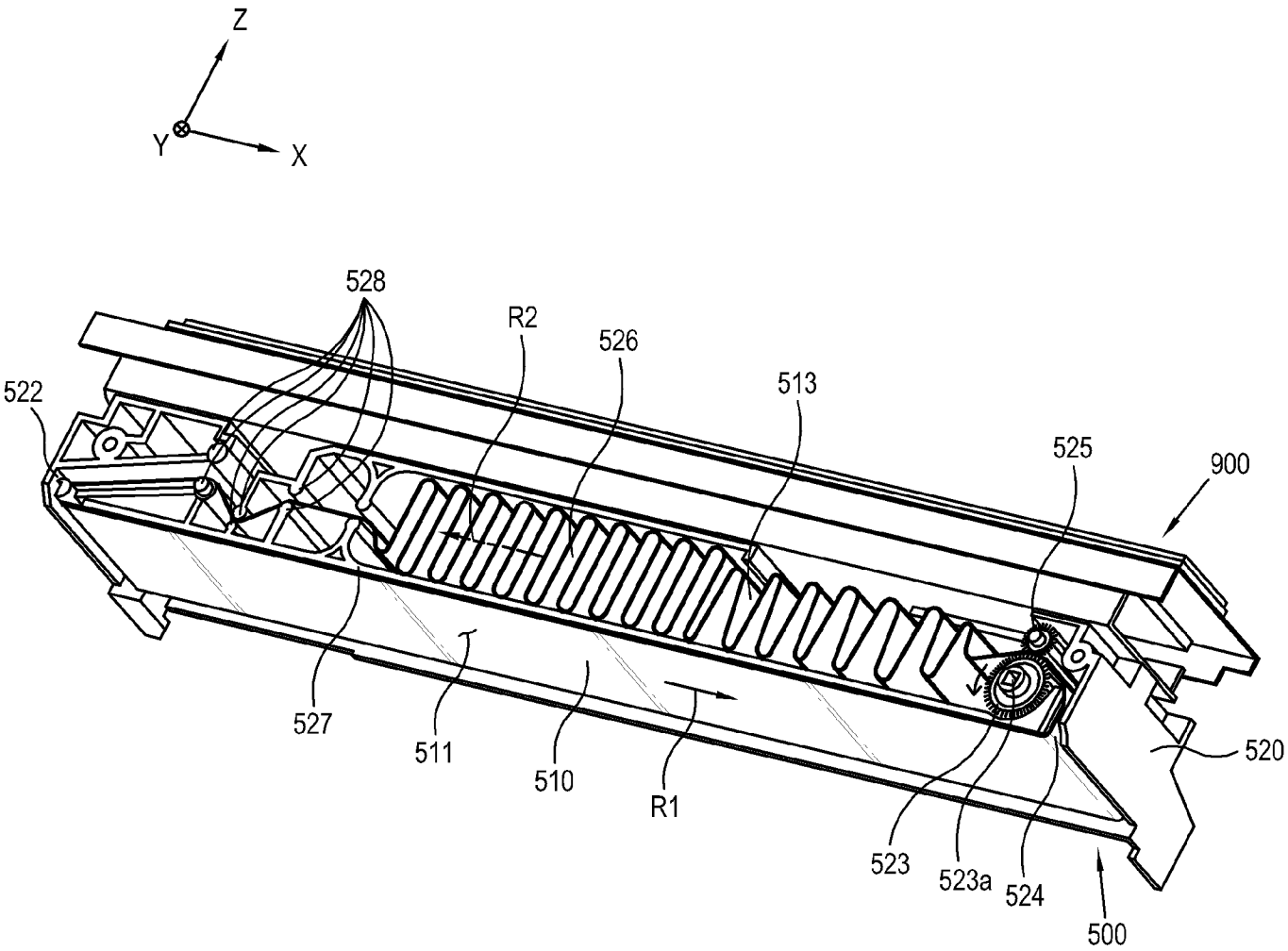
FIG. 14 is an enlarged main portion perspective view illustrating the scrapping unit in FIG. 13.

As illustrated in FIGS. 13 and 14, the scrapping unit 500 may include the endless belt 510, and a belt support frame 520. FIG. 14 is an enlarged main portion perspective view illustrating that a cover 528 is removed to illustrate in detail an inner configuration of the belt support frame 520 in FIG. 13.

The endless belt 510 can wipe a scrapped ink or a foreign material attached to a front end part in the upward direction Z of the plurality of wiper members 210.

The endless belt 510 may be formed of cloth and/or material having a liquid absorbability, such as cotton.

The endless belt 510 may circulate between an exposed position that is exposed toward the plurality of wiper members 210, and a non-exposed position that is not exposed toward the plurality of wiper members 210.

The belt support frame 520 may accommodate the endless belt 510 so that a part of the endless belt 510 can be exposed toward the plurality of wiper members 210. The belt support frame 520 can include a belt support surface 527 supporting the endless belt 510 so that the endless belt 510 can be unfolded in the exposed position, and a storing space 526 to store the endless belt 510 in a folded arrangement in the non-exposed position.

Since the endless belt 510 is stored in the storing space 526 in the folded state, at least a portion of endless belt 510 can be stored in the scrapping unit 500, and accordingly, a replacement period of the endless belt 510 can increase. Also, a storing space to store the endless belt 510 can be minimized, thereby reducing the size of the scrapping unit 500.

The belt support frame 520 may include an entrance hole 524 in which a flat part 511 of the endless belt 510 positioned in the belt support surface 527 enters toward the storing space 526, and a discharging hole 522 through which a folded part 513 of the endless belt 510 accommodated in the storing space 526 is discharged toward the belt support surface 527.

The endless belt 510 may be interposed between one pair of a driving roller 523 and a driven roller 525 rotatably disposed to the belt support frame 520. As the driving roller 523 and the driven roller 525 are engaged with each other so as to rotate, the endless belt 510 can circulate. The flat part 511 of the endless belt 510 may be accommodated in the storing space 526 through the entrance hole 524 along a direction indicated by solid arrow R1 in FIG. 14, and the folded part 513 of the endless belt 510 moves toward the discharging hole 522 along a direction indicated by dotted arrow R2.

The driving roller 523 can include a pinion shaft insertion hole 523*a* in which a pinion shaft of the endless belt driving pinion 521 illustrated in FIG. 13 is inserted, and the pinion shaft insertion hole 523*a* is provided to be coaxial with the rotation shaft of the driving roller 523. Accordingly, as the endless belt driving pinion 521 and the wiper rack 225*d* engage each other, the endless belt 510 can circulate in a direction illustrated in FIG. 14. The amount of a circulating movement of the endless belt 510 may be approximately 100 mm with respect to the widthwise direction X of the printing medium. However, this number (i.e. 100 mm) is just an example, and the amount of the circulating movement of the endless belt 510 may be appropriately selected (e.g., a length of the circulating movement may be selected to be greater than or less than 100 mm).

The amount of the circulating movement of the endless belt 510 may vary depending on, for example, a rotation number of the endless belt driving pinion 521. The rotation number of the endless belt driving pinion 521 may vary depending on, for example, the length in the widthwise direction X of the printing medium of the wiper rack 225*d*. Accordingly, by increasing or decreasing the length of the wiper rack 225*d*, etc., the amount of the circulating movement of the endless belt 510 can be adjusted (e.g., the circulating movement may be increased or decreased).

Also, as illustrated in FIG. 14, the belt support frame 520 may include a belt tension applying unit 528 disposed between the storing space 526 and the discharging hole 522 to apply a tension to the endless belt 510 so that the folded part 513 of the endless belt 510 accommodated in the storing space 526 can maintain a mainly flat state in the belt support surface 527.

As illustrated in FIG. 14, the belt tension applying unit 528 may support the endless belt 510 so that a path of the endless belt 510 that moves along a circulating movement direction of the endless belt 510 can be a zigzag movement. Here, the zigzag means that the movement path of the endless belt 510 may be bent at least two times. Accordingly, if a side of the endless belt 510 is drawn as the driving roller 523 and the driven roller 525 rotate, the other side of the endless belt 510 can be discharged outside through the discharging hole 522 under the state that a tension is applied thereto (i.e., under a flat state because of a friction force applied by the belt tension applying unit 528). The belt tension applying unit 528 may be variously changed irrespective of the shape and material thereof, as long as the belt tension applying unit 528 can apply the friction force to the endless belt 510 moved by the driving roller 523 and the driven roller 525. For example, to increase the friction force against the endless belt 510, a friction member having an increased surface friction coefficient such as rubber, sponge, etc. may be attached to a contact surface against the endless belt 510 of the belt tension applying unit 528. In exemplary embodiments of the present general inventive concept, the belt tension applying unit 528 may support the endless belt 510 so that the movement path of the endless belt 510 can be bent only once.

As illustrated in FIG. 1, the scrapping unit driving unit 600 may drive the scrapping unit 500 to move between the cleaning position L2 in which the scrapping unit 500 is positioned to the lower area A of the array head unit 110 to clean the plurality of wiper members 210, and the second treating position L1.

As illustrated in FIG. 1, the inkjet printer 100 may include a control unit 130 to control the wiper elevating unit 400, the widthwise direction driving unit 300 and the scrapping unit driving unit 600 to perform at least one of the wiping operation, the spitting operation and the scrapping operation according to a predetermined setting condition.

Hereinafter, processes of the wiping operation and the spitting operation will be described in detail by referring to FIGS. 8 to 12. In FIGS. 8 to 12, a reference position U is indicated to illustrate a movement degree of the printing medium P in the widthwise direction X of the wiping unit 200 (that is, the movement of the wiping unit 200 including the support member 220 and the shuttle 330).

As illustrated in FIG. 8, the wiping unit 200 may stand by in the first treating position J1 if there is no wiping operation or no scrapping operation signals received by the control unit 130).

Figure 9:
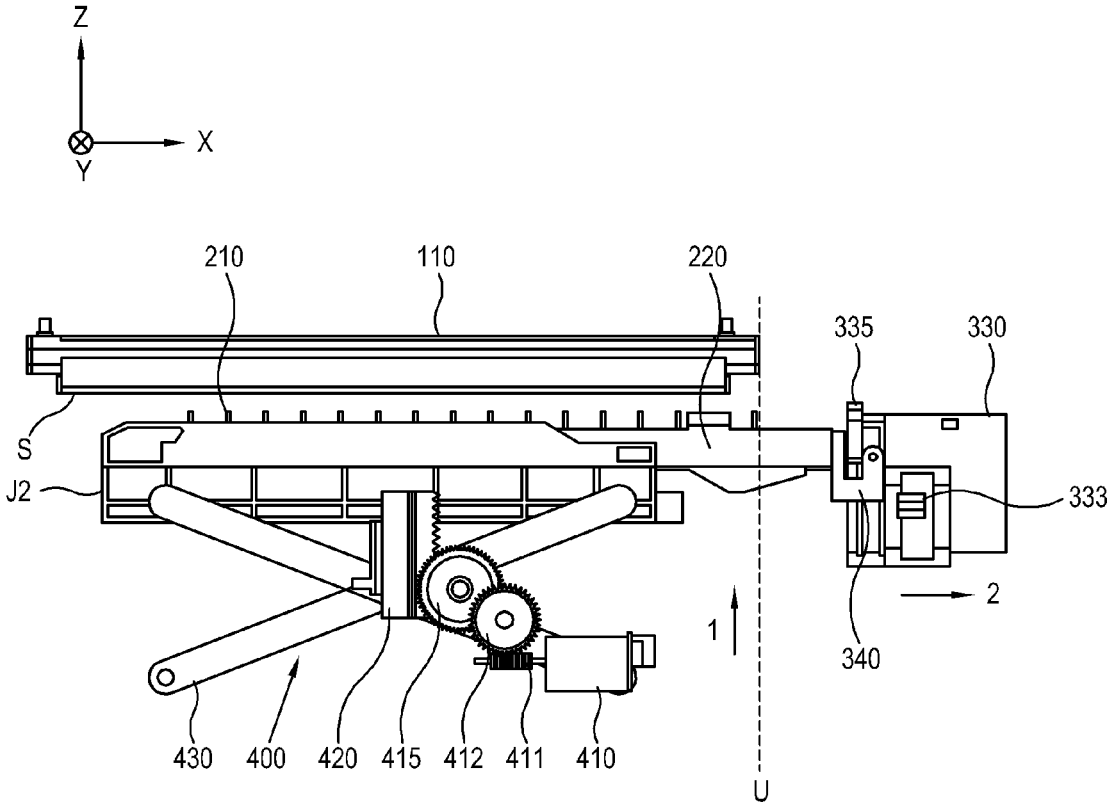

As illustrated in FIG. 9, if a wiping signal is received, the control unit 130 can control the wiper elevating unit 400 so that the plurality of wiper members 210 of the wiping unit 200 can move in an upward direction 1 to the approaching position J2. Accordingly, the second engagement unit 340 that is disposed to the support member 220 of the wiping unit 200 can be engaged with the first engagement unit 335 disposed on a surface of the shuttle 330. If the wiping unit 200 is positioned in the approaching position J2, the plurality of wiper members 210 of the wiping unit 200 may not contact to the ink discharging surface S of the array head unit 110. That is, there may be a predetermined interval between the plurality of wiper members 210 and the array head unit 110.

As indicated by a solid line arrow 2 in FIG. 9, the control unit 130 may move the shuttle 330 in the widthwise direction X of the printing medium.

As the shuttle 330 moves in the widthwise direction X of the printing medium, the support member 220 may also move in the widthwise direction X of the printing medium with respect to the wiper frame 230. Accordingly, the guide protrusion 250 in FIG. 4 formed to the support member 220 may interact with the guide groove 260 in FIG. 5 formed to an inner surface of the wiper frame 230 to move from the standby position H5 in FIG. 5 to the first position H1 in FIG. 5.

Figure 10:
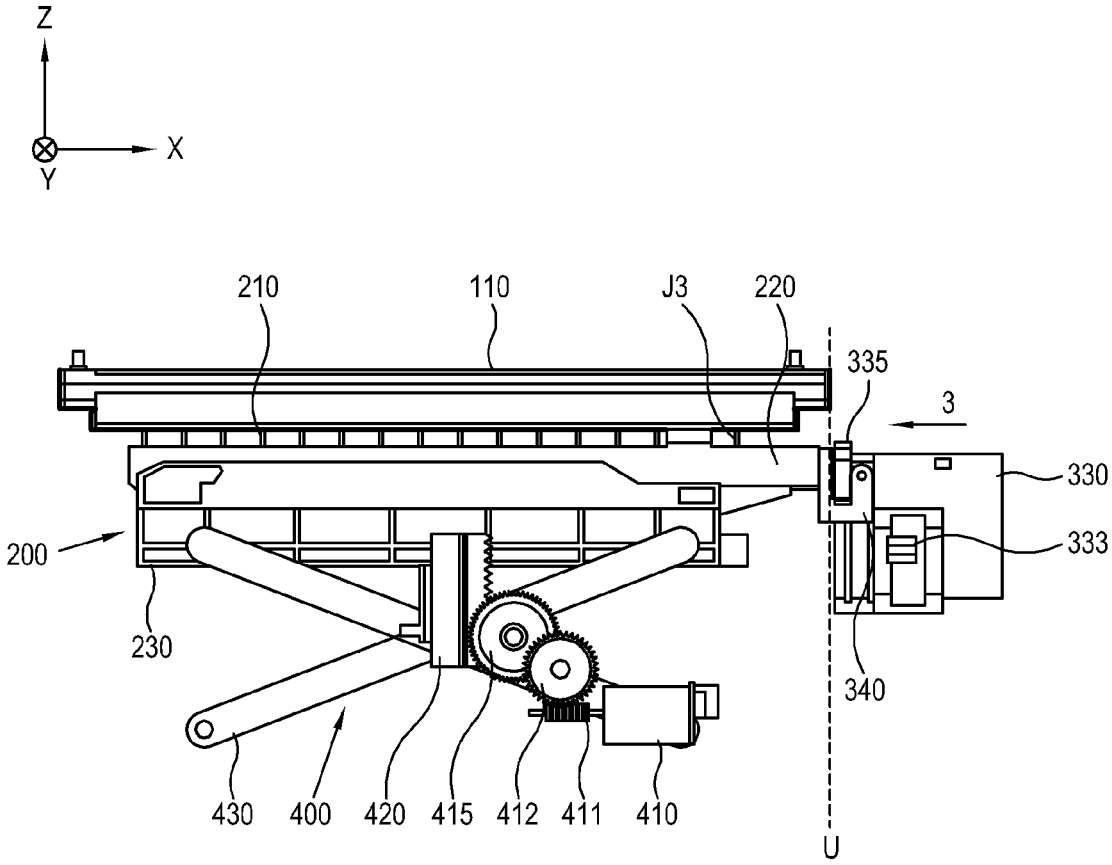

As illustrated in FIG. 10, the control unit 130 may control the widthwise direction driving unit 300 to move the support member 220 in the opposite direction 3 to the widthwise direction X of the printing medium. Accordingly, the guide protrusion 250 in FIG. 4 may interact with the guide groove 260 in FIG. 5 to move from the first position H1 in FIG. 5 to the second position H2 in FIG. 5.

Because of, among other things, the interaction of the guide groove 260 in FIG. 5 and the guide protrusion 250 in FIG. 4, the support member 220 may move in the upward direction Z by the height difference between the first position H1 in FIG. 5 and the second position H2 in FIG. 5. As the support member 220 moves in the upward direction Z, the plurality of wiper members 210 provided to an upper side of the support member 220 move to a contacting position J3 to contact the ink discharging surface S of the array head unit 110.

If the plurality of wiper members 210 directly contact the array head unit 110 by an operation of moving the wiping unit 200 in the upward direction Z (for example, only the upwardly moving operation of the solid line arrow 1 in FIG. 9), an impact may be applied to the array head unit 110 due to an increasing speed of the wiping unit 200. However, since the plurality of wiper members 210 can contact to the ink discharging surface S by moving the support member 220 in the widthwise direction X of the printing medium which is a transverse direction of the upward direction Z, an impact applied to the array head unit 110 due to an increasing speed of the wiping unit 200 can be removed.

As the support member 220 may continually move in the opposite direction 3 to the widthwise direction X of the printing medium P, the guide protrusion 250 in FIG. 4 also moves from the second position H2 in FIG. 5 to the third position H3 in FIG. 5. Each wiper member 210 may wipe the ink discharging surface S of the corresponding head chip C of the array head unit 110 by a movement amount of the guide protrusion 250 in FIG. 4 from the second position H2 in FIG. 5 to the third position H3 in FIG. 5.

As illustrated in FIG. 2, each wiper member 210 may contact the ink discharging surface S at first in a first contact position V1 corresponding to the second position H2 in FIG. 5 of the guide protrusion 250 in FIG. 4. As the support member 220 continually moves in the opposition direction 3 to the widthwise direction X of the printing medium, each wiper member 210 can move up to a second contact position V2 corresponding to the third position H3 in FIG. 5 of the guide protrusion 250 in FIG. 4 along a dotted line arrow V3 with contacting with the ink discharging surface S. Accordingly, the ink discharging surface S of each head chip C can be wiped, thereby removing a scrapped ink or a foreign material.

When each wiper member 210 moves up to the second contact position V2, the control unit 130 may control the array head unit 110 so that a nozzle inside each head chip C can spit an ink to prevent a nozzle blocking. This spitted scrapped ink may be transmitted to the spitting space G in FIG. 4 of the support member 220 to enter the scrapped ink accommodating unit 225*a* in FIG. 4 and the spitting operation may be completed.

Figure 11:
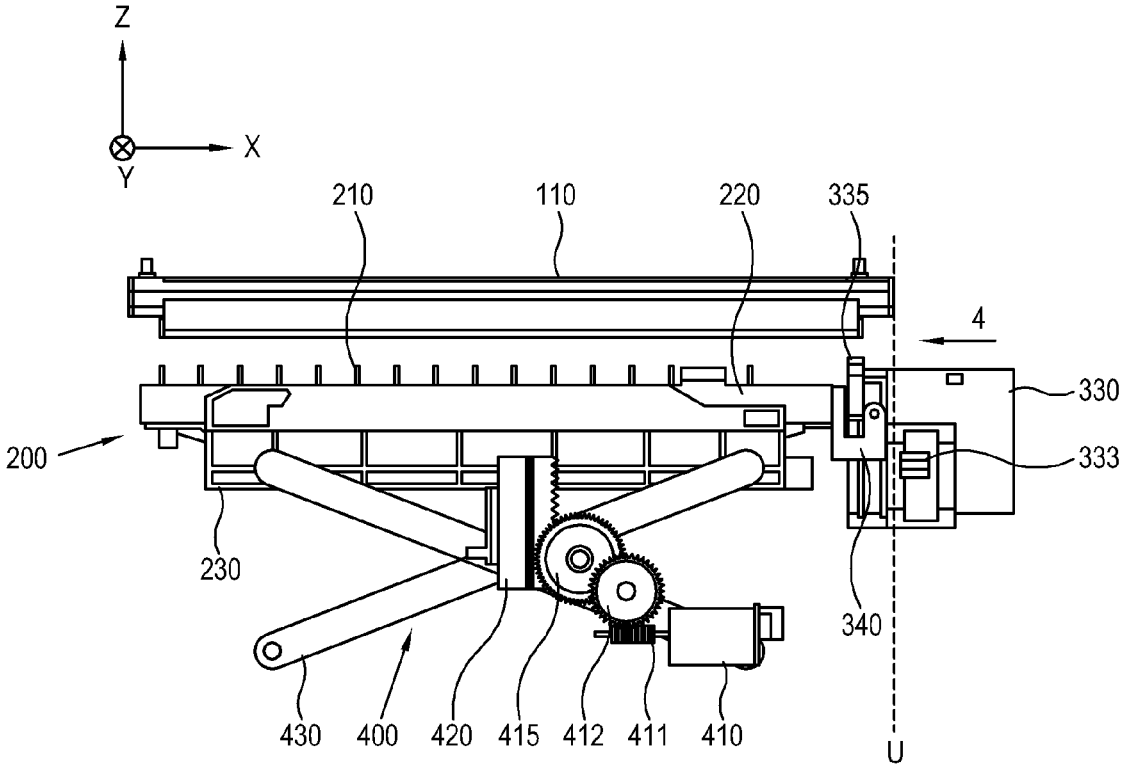

As illustrated in FIG. 11, if the support member 220 continually moves in the opposite direction 4, the guide protrusion 250 in FIG. 4 may move downwardly from the third position H3 in FIG. 5 to the fourth position H4 in FIG. 5. Accordingly, the support member 220 may also downwardly move by the height difference between the third position H3 in FIG. 5 and the fourth position H4 in FIG. 5 with respect to the wiper frame 210.

Figure 12:
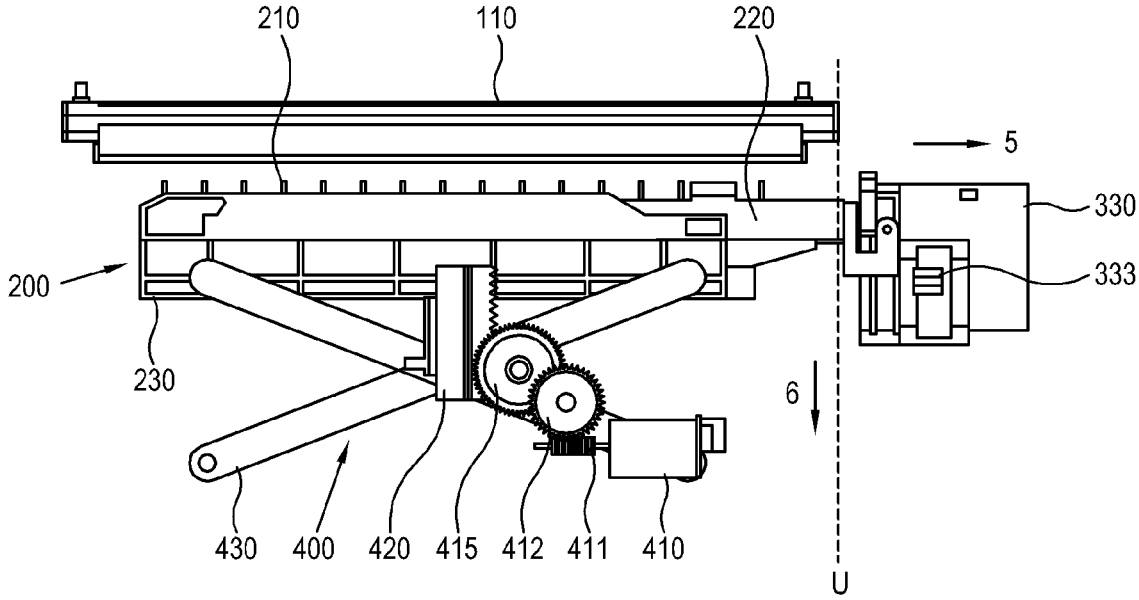

The control unit 130 can control the widthwise direction driving unit 300 so that the wiping unit 200, (i.e., including the support member 220) can move again in the widthwise direction X of the printing medium. As illustrated in FIG. 12, the support member 220 may move in the widthwise direction X of the printing medium along a solid line arrow 5 to be positioned at the original position.

The control unit 130 controls the wiper elevating unit 400 so that the wiping unit 200 can downwardly move to the initial treating position J1 in FIG. 8 along a solid line arrow 6 illustrated in FIG. 12.

Through the processes illustrated by a series of arrows (e.g., 1->2->3->4->5->6) illustrated in FIGS. 8 to 12, the wiping unit 200 can wipe the ink discharging surface S of the array head unit 110.

Figure 15:
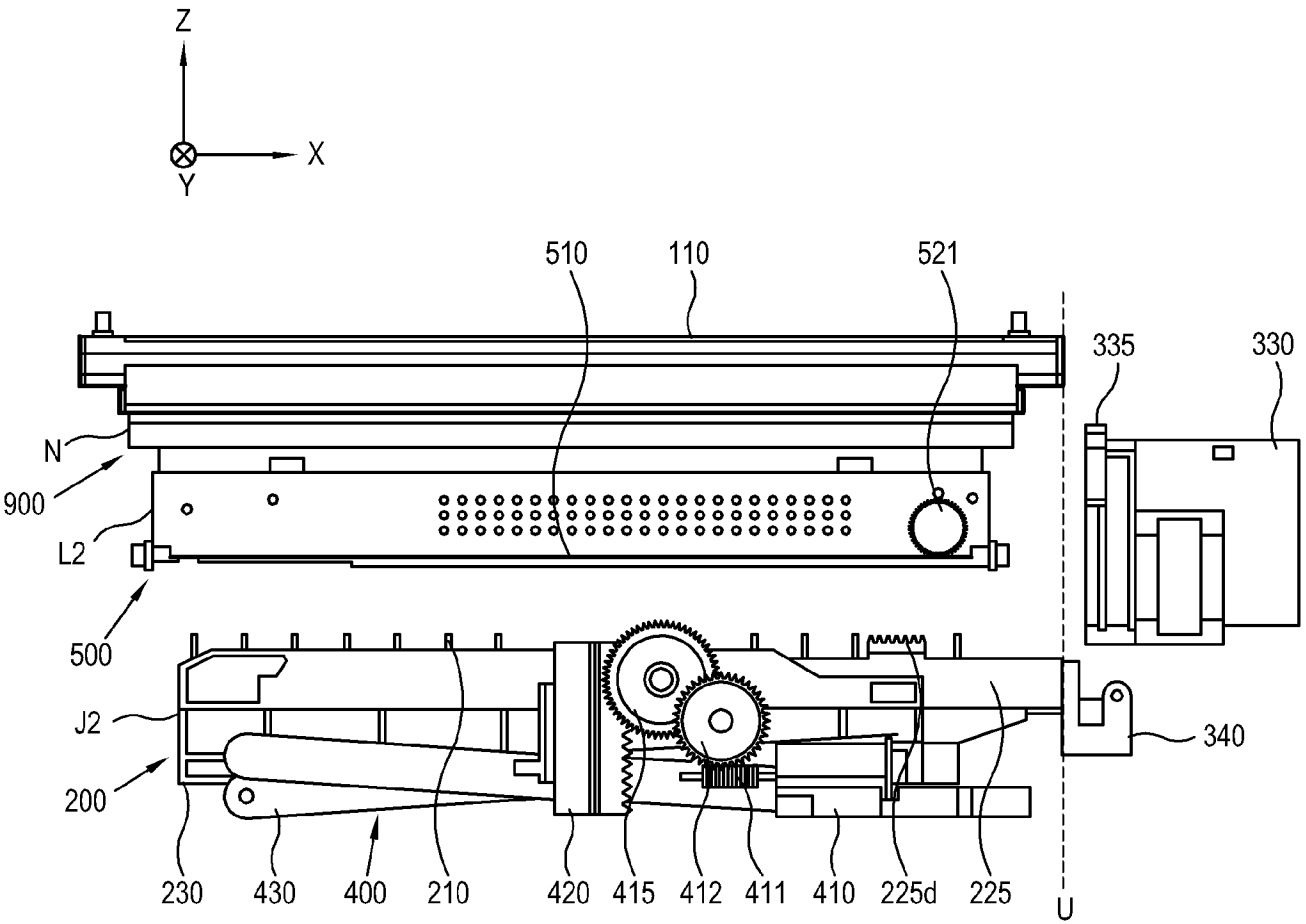
FIGS. 15 to 18 illustrate processes of a scrapping operation of the inkjet printer in FIG. 1 according to exemplary embodiments of the present general inventive concept.

As illustrated in FIGS. 13 to 15, the inkjet printer 100 according to the present general inventive concept may further include a capping unit 900 interlocking with moving of the scrapping unit 500 between the cleaning position L2 and the second retreating position L1 to move between a capping position N capping the ink discharging surface S of the array head unit 110 and a third retreating position (not illustrated) retreating from the capping position N.

While a printing operation is not performed, the capping unit 900 may cap the ink discharging surface S to minimize and/or prevent a foreign material from flowing in through the nozzle of the array head unit 110.

The capping unit 900 may be coupled to the scrapping unit 500 to integrally move with the scrapping unit 500 in an upper side of the scrapping unit 500. In exemplary embodiments of the present general inventive concept, a separate driving unit to drive the capping unit 900 may be omitted to simplify the driving configuration thereof and reducing cost.

Hereinafter, a process of the scrapping operation will be described in detail by referring to FIGS. 1 and 15 to 18.

If a scrapping signal is received, the control unit 130 may control the scrapping unit driving unit 600 to move the scrapping unit 500 from the second retreating position L1 to the cleaning position L2. FIG. 15 illustrates the scrapping unit 500 can be moved to the cleaning position L2. As the capping unit 900 may be coupled so as to integrally move with the scrapping unit 500, if the scrapping unit 500 moves to the cleaning position L2, the capping unit 900 also may move to the capping position N capping the ink discharging surface of the array head unit 110.

Figure 16:
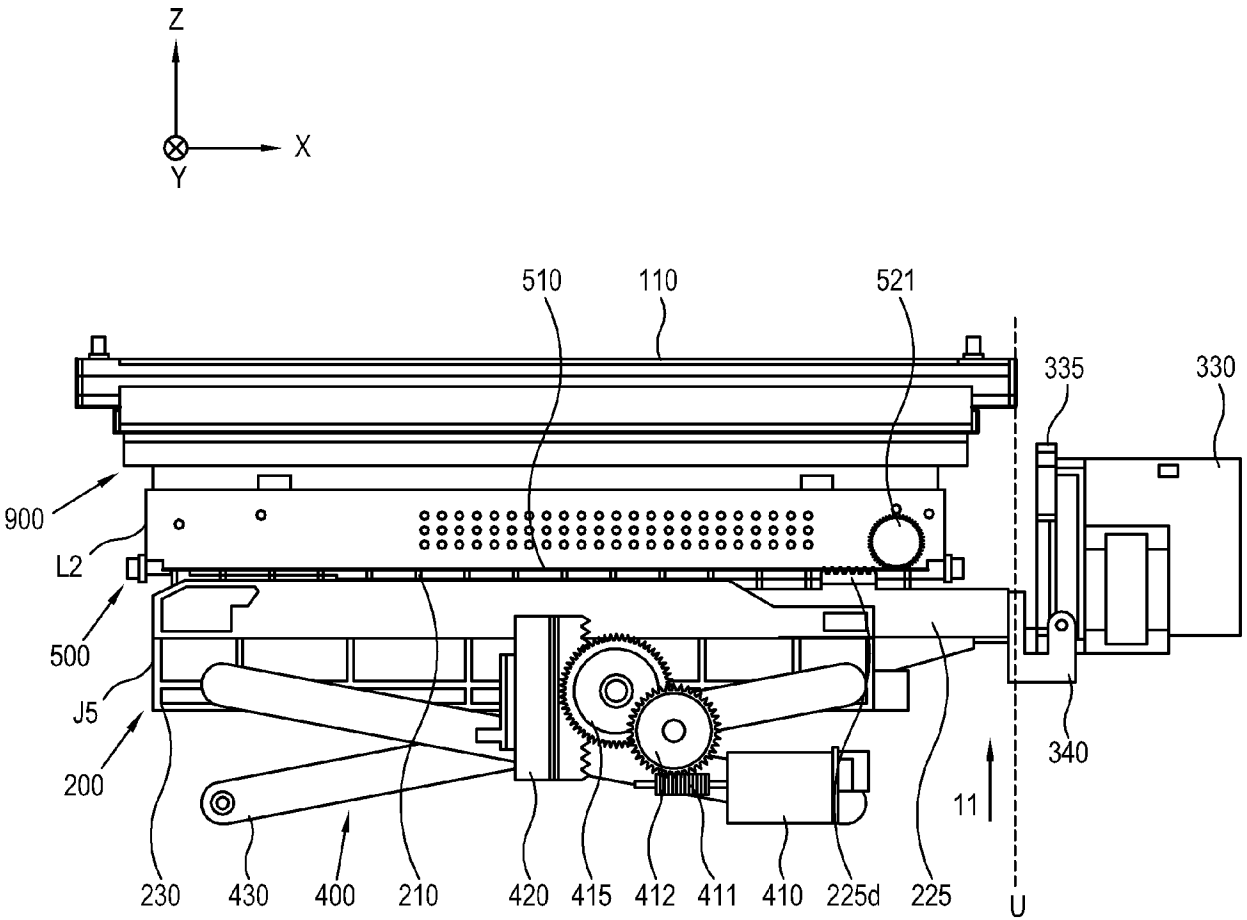

The control unit 130 may control the wiper elevating unit 400 so that the wiping unit 200 moves in the upward direction Z from the first retreating position J1 as indicated by a solid line arrow 11 in FIG. 16. The wiping unit 200 may not move up to the approaching position J2 in FIG. 9 in the wiping operation described above, but may move upwardly up to an endless belt contact position J5 in which the plurality of members 210 contact to the endless belt 510 of the scrapping unit 500. Since the endless belt 510 may not be as sensitive to an impact as the array head unit 110 and it is not necessary to minimize an impact, the wiping unit 200 can be upwardly moved by a single elevating operation to the position in which the plurality of wiper members 210 contact to the endless belt 510.

If the wiping unit 200 upwardly moves to the endless belt contact position J5, the second engagement unit 340 disposed to the support member 220 may be engaged and coupled to the shuttle 330, thereby reciprocating in the widthwise direction X of the printing medium P together with the shuttle 330.

Figure 17:
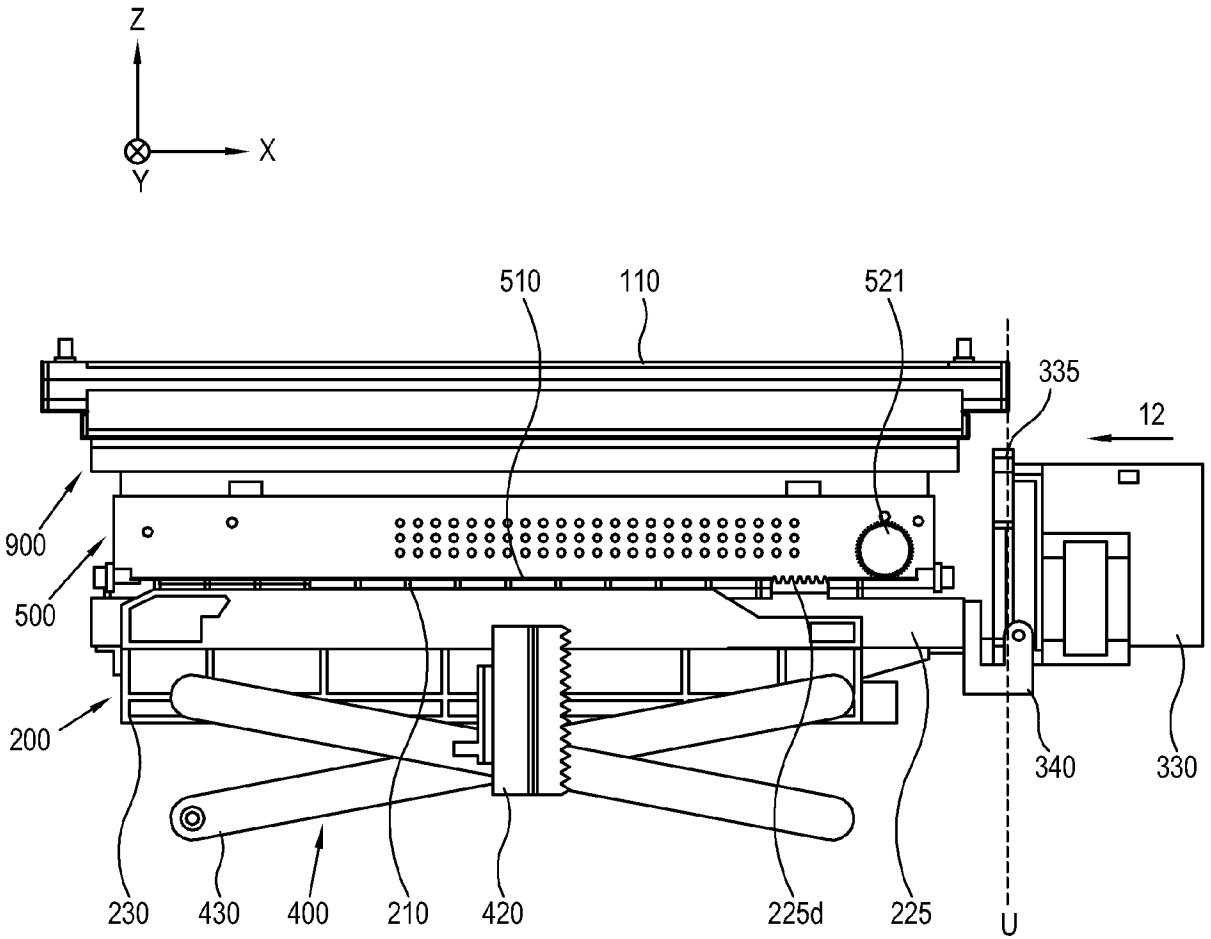

As illustrated in FIG. 17, the control unit 130 can control the widthwise direction driving unit 300 to move the support member 220 in the opposite direction to the widthwise direction X of the printing medium with respect to the wiper frame 230. That is, the support member 220 can be moved along a solid line arrow 12. Accordingly, the plurality of wiper members 210 of the wiping unit 220 move in the opposite direction to the widthwise direction X of the printing medium P by contacting the endless belt 510 so that a scrapped ink or a foreign material existing at an end part of the wiper member 210 can be wiped and cleaned.

Here, the movement amount of the support member 220 may be approximately 10 mm. The movement amount of the support member 220 may be changed to be appropriate to a use environment. Also, the movement amount of the support member 220 is not stationary, and may vary. For example, if a printing number increases or if a performance period of the scrapping operation increases, the scrapping ability of the wiper member 210 may be increased by increasing the movement amount of the support member 220.

Figure 18:
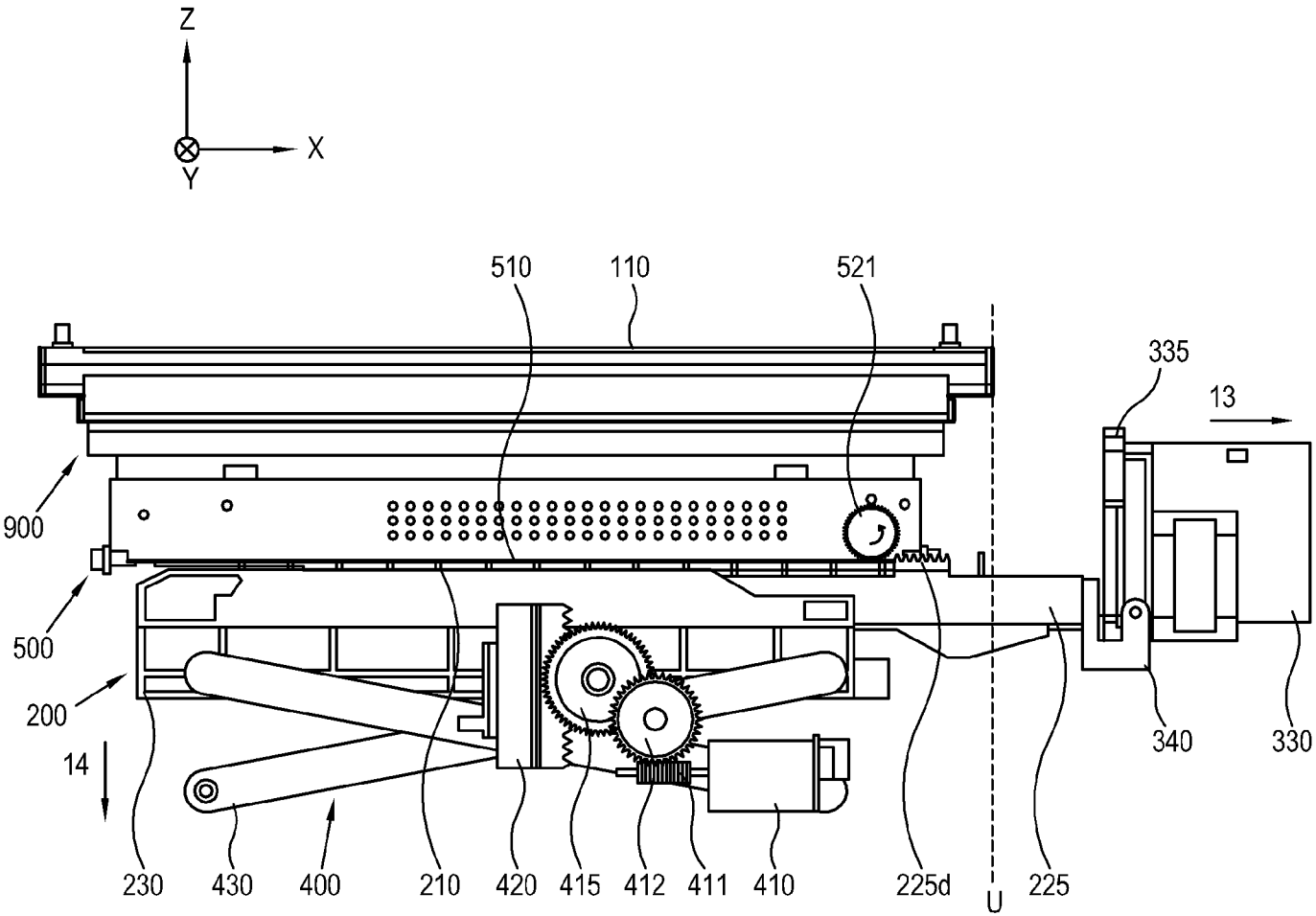

As illustrated in FIG. 18, the control unit 130 can control the widthwise direction driving unit 300 to move the support member 220 in the widthwise direction X of the printing medium again. That is, the support member can be moved along a solid line arrow 13.

As the support member 220 moves in the widthwise direction X, the wiper rack 225*d* disposed to the support member 220 can pass through the endless belt driving pinion 521 to rotate the endless belt driving pinion 521.

A polluted portion of the endless belt 510 polluted by a scrapped ink or a foreign material of the wiper member 210 can move in the widthwise direction X of the printing medium, and a clean portion of the endless belt 510 existing in the storing space 526 of the scrapping unit 500 is discharged through the discharging hole 522. Accordingly, in a next scrapping operation, since the wiper member 210 is scrapped by a clean portion of the endless belt 510 that is not polluted, the wiper member 210 can be prevented from being inversely polluted by the polluted endless belt 510 or the pollution to the wiper member 210 may be minimized.

If there is a user demand and/or if a signal is received by the control unit 130, the wiping operation, the spitting operation and the scrapping operation may be controlled by the control unit 130 to be performed in order as a series of maintenance processes.

As illustrated in FIG. 1, the inkjet printer 100 according to the present general inventive concept may include the platen 700 moving between a support position K2 supporting a printing medium P to be printed by an ink discharged from the ink discharging surface S and a fourth retreating position K1 retreating from the support position K2, a platen driving unit 900 driving the platen 700.

In exemplary embodiments of the present general inventive concept, if the capping unit 900 is omitted, the platen 700 may be disposed inside an apparatus to be stationary without being moved.

The control unit 130 may control the platen driving unit 900 so that the platen 700 can be positioned in the support position K2 in a normal state. Accordingly, if there is a printing demand by a user, and/or if a control signal for a printing operation is received by the control unit 130, a printing operation can be readily performed.

If there is a printing demand from a user and/or a control signal for a printing operation is received by the control unit 130 while the wiping operation, the spitting operation and the scrapping operation are performed, the control unit 130 may inform the user that a printing operation may not presently be performed because of the corresponding state. The information may be displayed in an operation panel (not illustrated), or may be output through a speaker.

An inkjet printer according to a second exemplary embodiment of the present general inventive concept may include a wiping unit 200*a* of a second exemplary embodiment illustrated in FIGS. 19 to 23. The wiping unit 200*a* may replace the wiping unit 200 of the ink printer 100 in exemplary embodiments of the present general inventive concept.

Figure 19:
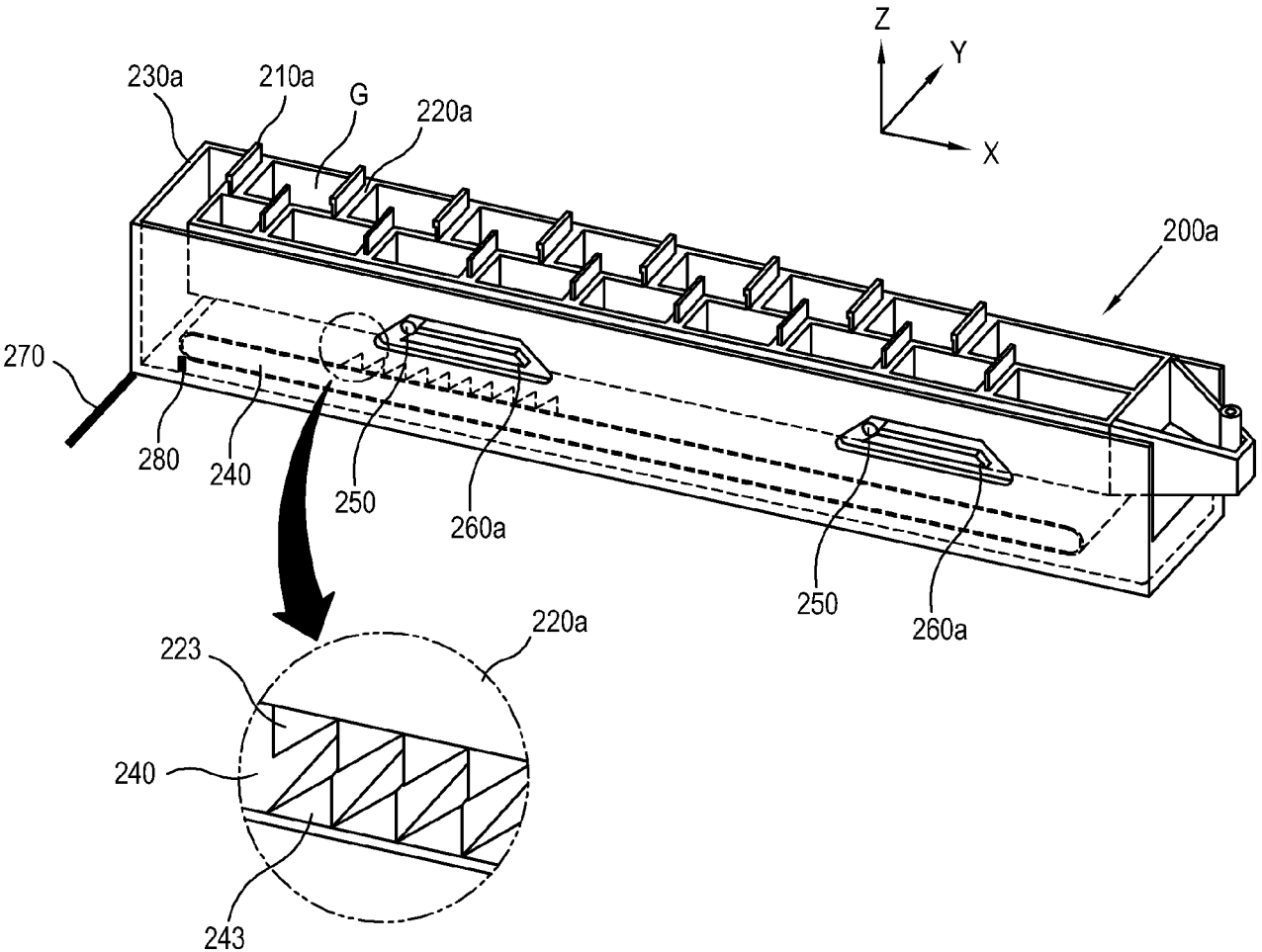
FIG. 19 is a schematic perspective view illustrating a wiping unit according to exemplary embodiments of the present general inventive concept.

As illustrated in FIG. 19, the wiping unit 200*a* according to exemplary embodiments of the present general inventive concept can include a plurality of wiper members 210*a*, a support member 220*a* to reciprocate in a widthwise direction X of a printing medium with respect to a wiper frame 230*a* to support the plurality of wiper members 210*a*, and the wiper frame 230*a* to movably support the support member 220*a*.

The support member 220*a* can be formed with a scrapped ink transmission hole G which a scrapped ink transmits in the spitting operation, and the transmitting ink falls onto a spitting belt 240. A support member teeth 223 to be engaged with a belt teeth 243 can be formed to a facing surface toward the spitting belt 240 of the support member 220*a*.

The wiping unit 200*a* may include the spitting belt 240 to circulate along the widthwise direction X of the printing medium, a driving unit (not illustrated) to drive the spitting belt 240, the belt teeth 243 formed to a facing surface toward the support member 220*a* of the spitting belt 240, and a cleaning blade 280 to rake a scrapped ink or a foreign material existing on the spitting belt 240 from the spitting belt 240 to clean the spitting belt 240.

The scrapped ink or foreign material raked by the cleaning blade 280 can be accommodated in the wiper frame 230*a*, and the accommodated ink or foreign material is discharged outside the wiper frame 230*a* through a hose 270.

If the support member 220*a* moves in the opposite direction to the widthwise direction X of the printing medium to return to the original position, the belt teeth 243 may be engaged with the support member teeth 223 of the support member 220*a* to circulate the spitting belt 240.

Also, the wiping unit 200*a* may include a guide protrusion 250 protruding from the opposite sides of the support member 220*a* toward an inner surface of the wiper frame 230*a*, and a guide groove 260*a* interlocking with the guide protrusion 250 to interlock with a reciprocating of the support member 220*a* in the widthwise direction X of the printing medium P so that the plurality of wiper members 210 can contact and be withdrawn to and from the ink discharging surface S in FIG. 1 of the array head unit 110 in FIG. 1.

The guide groove 260*a* may be provided to the opposite sides of the wiper frame 230*a*. In exemplary embodiments of the present general inventive concept, the guide protrusion 250 may be provided to the wiper frame 230*a*, and the guide groove 260*a* may be provided to the support member 220*a*.

Hereinafter, processes of a wiping operation and a spitting operation of the wiping unit 200*a* according to exemplary embodiments of the present general inventive concept will be described by referring to FIGS. 20 and 21. Here, it is assumed that the wiping unit 200*a* moves upwardly from the first retreating position J1 in FIG. 8 up to the approaching position J2 in FIG. 9 as described above.

Figure 20:
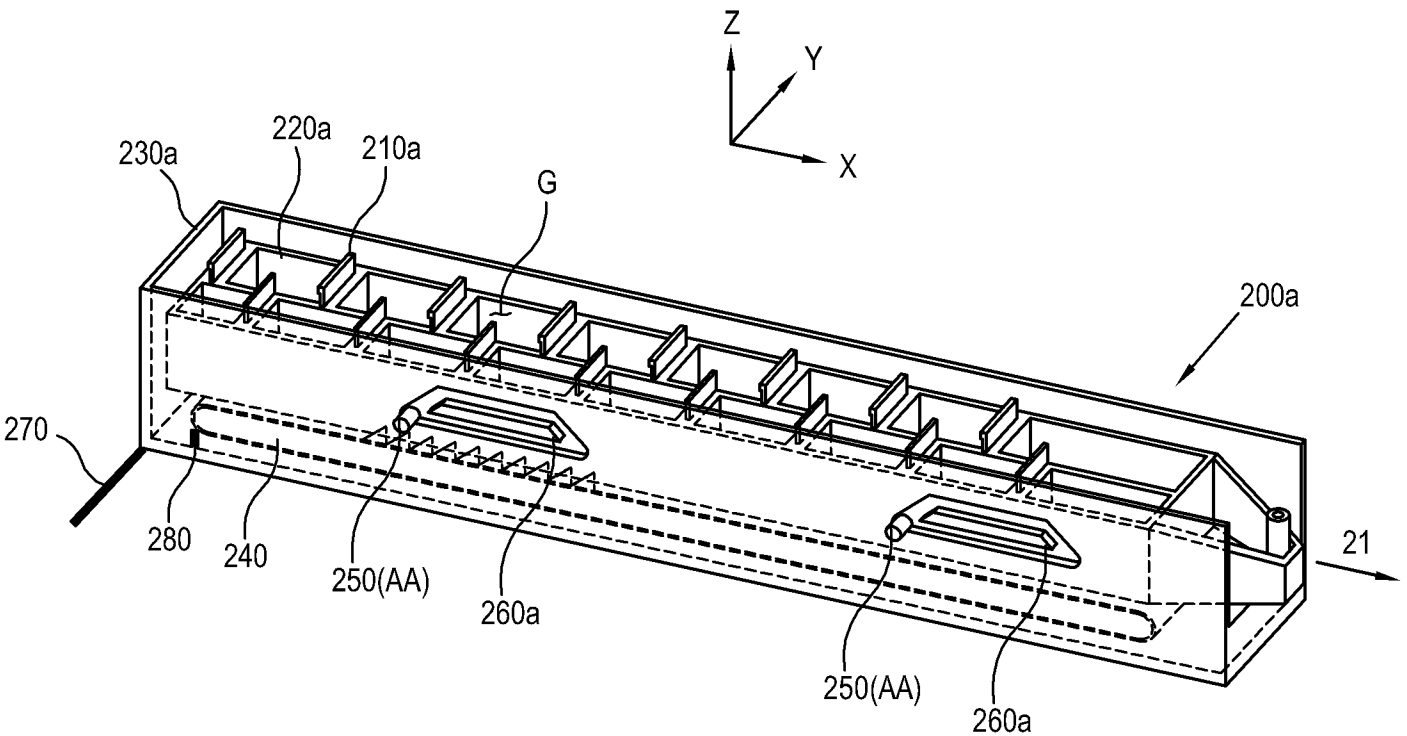
FIGS. 20 to 23 illustrate processes of a wiping operation by the wiping unit in FIG. 19 according to exemplary embodiments of the present general inventive concept.

As illustrated in FIG. 20, the support member 220*a* moves in the widthwise direction X of the printing medium P. That is, the support member 220*a* moves along a direction illustrated by arrow 21. Accordingly, the guide protrusion 250 disposed to the support member 220*a* can move upwardly along an inclined surface from a first position AA in FIG. 20 to a second position AB in FIG. 21.

As the guide protrusion 250 moves upwardly, the support member 220*a* may also move in an upward direction Z, and the plurality of wiper members 210*a* contact to the ink discharging surface S in FIG. 1 of the array head unit 110 in FIG. 1.

Figure 21:
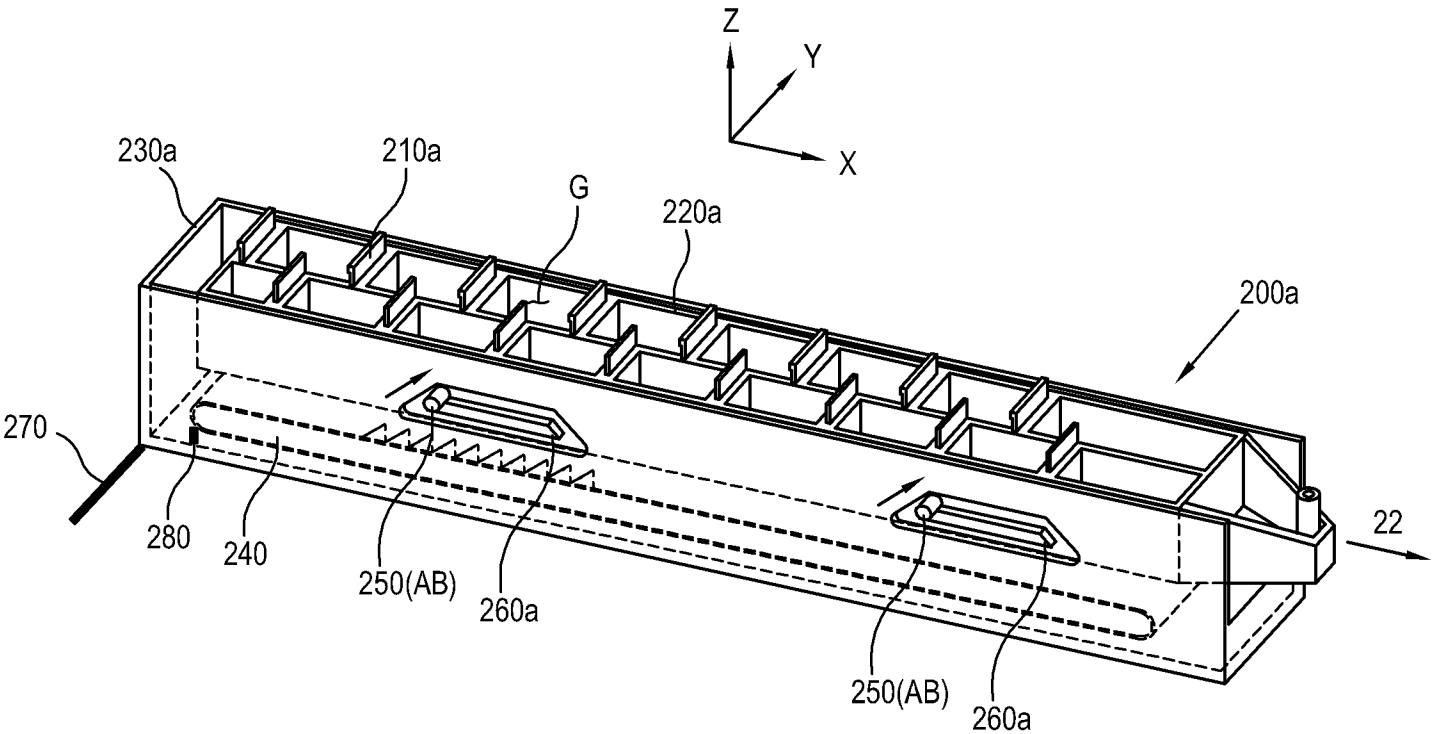
Figure 22:
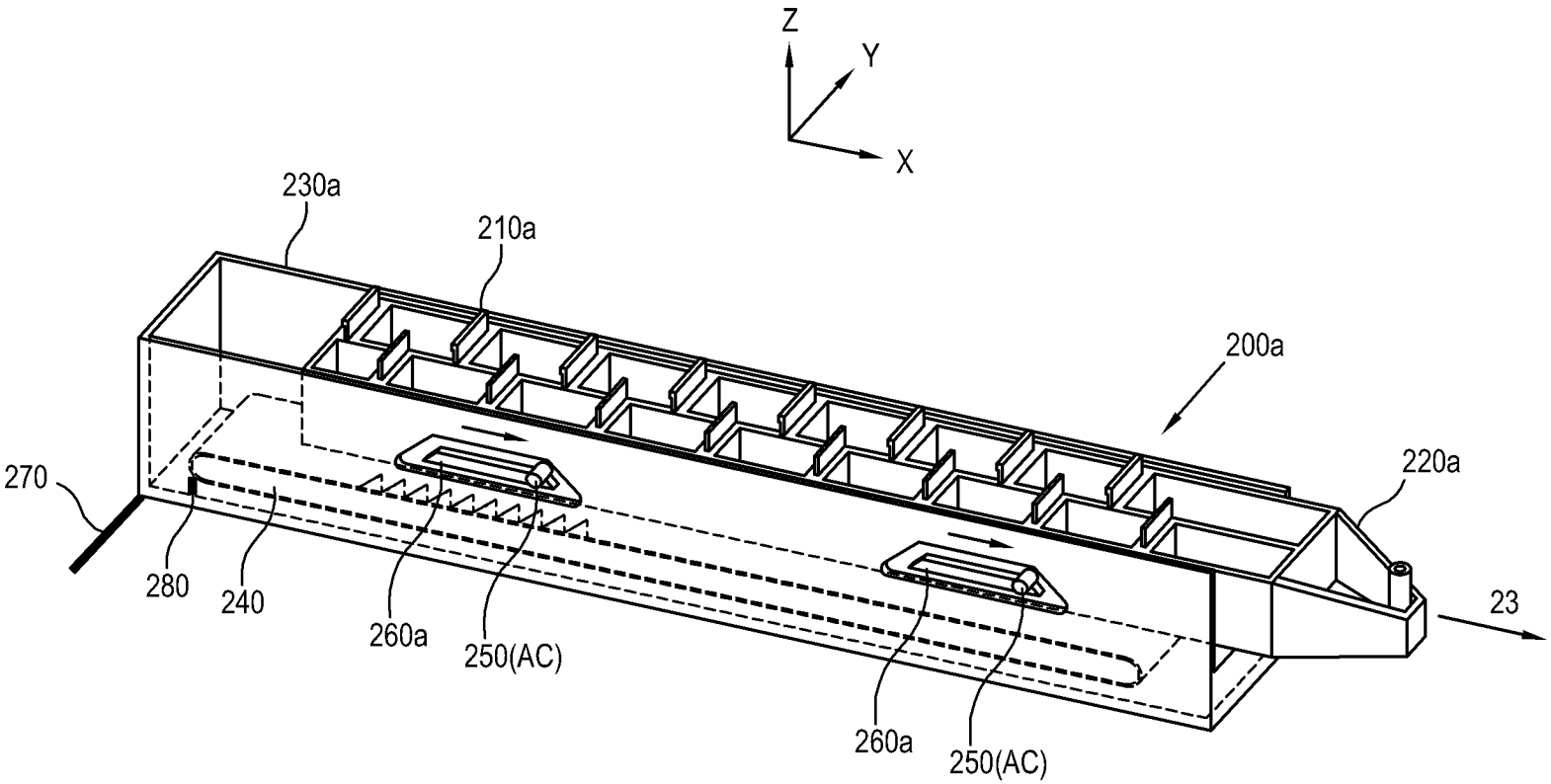

As the support member 220*a* continually moves in the widthwise direction X of the printing medium as indicated by an arrow 22 in FIG. 21, the guide protrusion 250 may move from the second position AB in FIG. 21 to a third position AC in FIG. 22. Accordingly, the plurality of wiper members 210*a* contacting the ink discharging surface S in FIG. 1 can wipe the ink discharging surface S in FIG. 1.

After the wiping, an ink can be discharged from the ink discharging surface S in FIG. 1, and the ink transmits the scrapped ink transmission hole G to fall to the spitting belt 240. Accordingly, the spitting operation may be completed.

After the spitting operation, the support member 220*a* may move in the widthwise direction X of the printing medium as illustrated by an arrow 23 in FIG. 22. Accordingly, the guide protrusion 250 may move downwardly along an inclined surface from the third position AC in FIG. 22 to a fourth position AD. As the guide protrusion 250 moves downwardly, the plurality of wiper members 210*a* contacting the ink discharging surface S in FIG. 1 may be distanced from the ink discharging surface S in FIG. 1 to be positioned in the approaching position J2.

Figure 23:
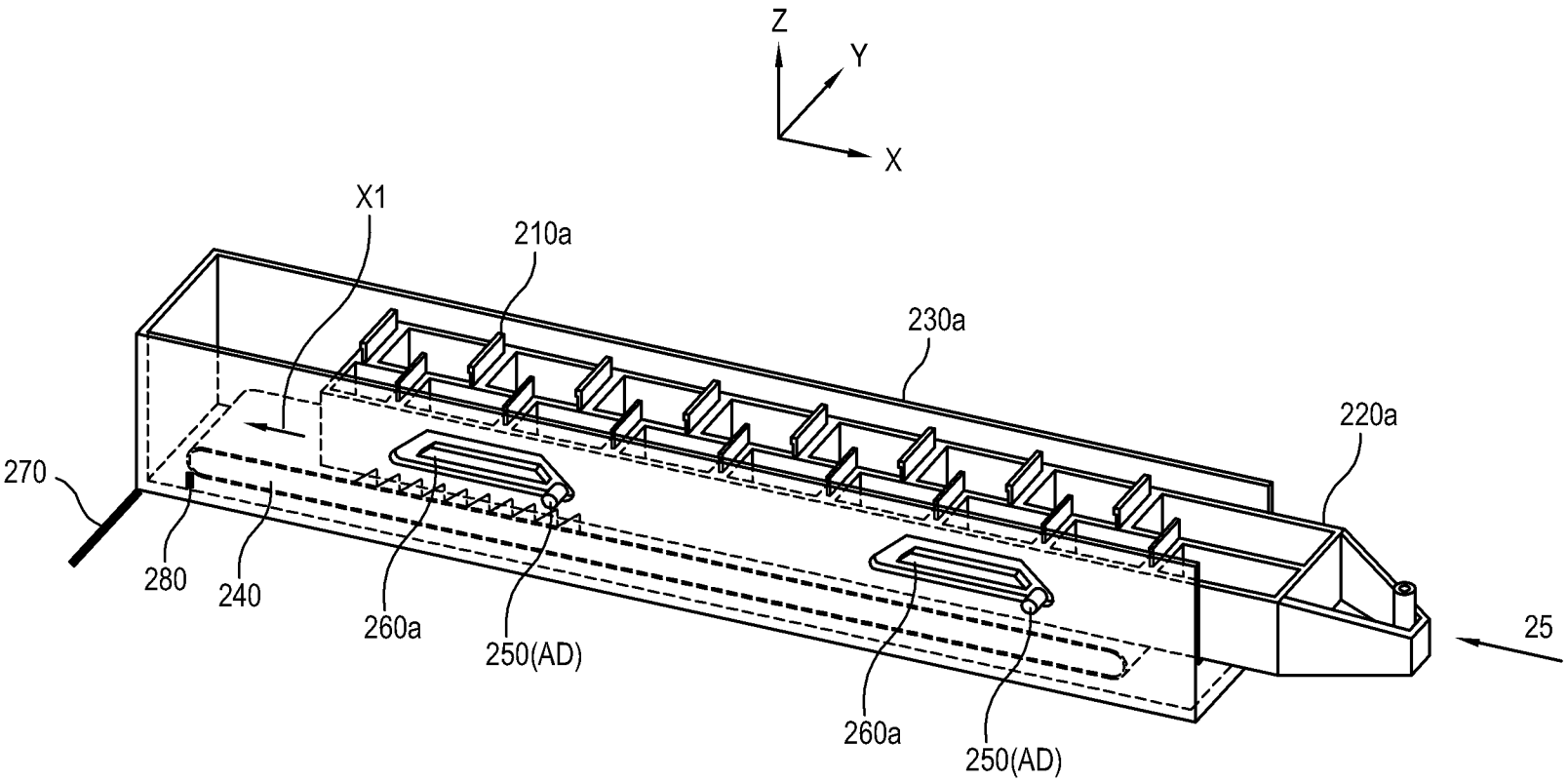

To return from the position in FIG. 23 to the original position illustrated in FIG. 20, the supporting member 220*a* may move in the opposite direction to the widthwise direction X of the printing medium, that is, along a direction illustrated by an arrow 25 in FIG. 23.

The support member teeth 243 may be disposed on a lower surface of the support member 220*a* to engage with the belt teeth 243 to circulate the spitting belt 240 in the opposite direction X1 to the widthwise direction X of the printing medium. Accordingly, a scrapped ink or a foreign material existing in the spitting belt 240 can be raked by the cleaning blade 280 to fall into the wiper frame 230*a*. The scrapped ink falling into the wiper frame 230*a* can be discharged outside through the hose 270. By raking a scrapped ink or a foreign material on the spitting belt 240, the lifespan of the spitting belt 240 can be increased and the replacement period can be elongated.

Also, since the spitting belt 240 polluted by a scrapped ink falling through the scrapped ink transmission hole G in a spitting operation is circulated, a scrapped ink falls to the clean spitting belt 240 may not pollute in the next spitting operation. Accordingly, a scrapped ink can be dispersed evenly over all spitting belt 240, and can be prevented from being concentrated to a specific area of the spitting belt 240, and/or the concentration of the scrapped ink in a specific area may be minimized. Accordingly, the lifespan of the spitting belt 240 can be increased.

As described above, the scrapping unit 500 of the present general inventive concept is exemplarily described to clean the wiper member 210 of the inkjet printer 100. However, the scrapping unit 500 may clean an element in an image forming apparatus which is necessary to be cleaned.

As described above, a scrapping unit and an image forming apparatus having the same according to the present general inventive concept may have at least the following features.

In exemplary embodiments of the present general inventive concept, the lifespan of an endless belt of a scrapping unit may be elongated, thereby reducing a maintenance cost.

In a scrapping operation, a wiper member can be cleaned by using an endless belt not polluted, thereby preventing the wiper member from being polluted inversely by the endless belt. Accordingly, in a wiping operation, an array head unit can be wiped, thereby improving a maintenance performance.

In exemplary embodiments of the present general inventive concept, an endless belt of a scrapping unit can be stored with being folded to store a lot of endless belt, thereby elongating a replacement period to improve maintenance. Also, a storing space necessary to store an endless belt can be minimized, thereby reducing the size of a product.

Although several exemplary embodiments of the present general inventive concept have been illustrated and described, it will be appreciated by those skilled in the art that changes may be made in these exemplary embodiments without departing from the principles and spirit of the general inventive concept, the scope of which is defined in the appended claims and their equivalents.

What is claimed is:

1. A scrapping unit to clean a polluted member disposed in an image forming apparatus which forms an image on a printing medium and stained by a polluting material, the scrapping unit comprising:

an endless belt to circulate between an exposed position where a surface of the endless belt is exposed toward the polluted member, and a non-exposed position where the surface of the endless belt is not exposed with respect to the polluted member; and a belt support frame having a belt support surface to support the endless belt so that the endless belt is unfolded in the exposed position, and a storing space to store the endless belt so that the endless belt is folded in the non-exposed position, wherein the endless belt is configured to move along a widthwise direction of the printing medium on the belt support surface.

2. The scrapping unit according to claim 1, wherein the belt support frame comprises:

an entrance hole through which the endless belt flows toward the storing space from the belt support surface; and a discharging hole through which the endless belt flows toward the belt support surface from the storing space.

3. The scrapping unit according to claim 1, wherein the belt support frame further comprises:

a belt tension applying unit to apply a tension to the endless belt to expose the endless belt as substantially flat toward the belt support surface from the storing space.

4. The scrapping unit according to claim 1, further comprising:

a driven roller which is disposed in the belt support frame;

a driving roller which is disposed in the belt support frame, and is engaged with the driven roller, with the endless belt interposed therebetween; and a driving pinion which is disposed so as to be exposed outside the belt support frame to drive the driving roller.

5. The scrapping unit according to claim 3, wherein the belt tension applying unit supports the endless belt so that a movement path of the endless belt is a zigzag movement path.

6. An image forming apparatus, comprising:

an image forming unit to form an image on a printing medium;

a polluted member which is disposed in the image forming apparatus, and is stained by a polluting material; and a scrapping unit configured to clean the polluted member, the scrapping unit comprising:

an endless belt to circulate between an exposed position where a surface of the endless belt is exposed toward the polluted member, and a non-exposed position where the surface of the endless belt is not exposed with respect to the polluted member; and a belt support frame having a belt support surface to support the endless belt so that the endless belt is unfolded in the exposed position, and a storing space to store the endless belt so that the endless belt is folded in the non-exposed position, wherein the endless belt is configured to move along a widthwise direction of the printing medium on the belt support surface.

7. The image forming apparatus according to claim 6, wherein the belt support frame comprises:

an entrance hole through which the endless belt flows toward the storing space from the belt support surface, and a discharging hole through which the endless belt flows toward the belt support surface from the storing space.

8. The image forming apparatus according to claim 6, wherein the belt support frame further comprises:

a belt tension applying unit to apply a tension to the endless belt to expose the endless belt as substantially flat toward the belt support surface from the storing space.

9. The image forming apparatus according to claim 6, wherein the image forming unit includes an array head unit which is disposed with a plurality of head chips to have a length to correspond to a widthwise direction of a printing medium, and discharges an ink, and the polluted member includes a plurality of wiper members which are disposed along the widthwise direction of the printing medium to wipe an ink discharging surface of the array head unit.

10. The image forming apparatus according to claim 6, wherein the endless belt of the scrapping unit is driven to interlock with a movement in the widthwise direction of the printing medium of the polluted member.

11. The image forming apparatus according to claim 8, wherein the belt tension applying unit supports the endless belt so that a movement path of the endless belt is a zigzag movement path.

12. The image forming apparatus according to claim 9, further comprising:

a wiping unit having a support member to support the plurality of wiper members, and to move up and down between an approaching position approaching the array head unit and a first retreating position retreating from the approaching position;

a widthwise direction driving unit to move the wiping unit in the widthwise direction of the printing medium so that the plurality of wiper members move in the widthwise direction of the printing medium; and a wiper elevating unit to elevate the wiping unit between the approaching position and the first retreating position.

13. The image forming apparatus according to claim 10, wherein the scrapping unit further comprises a driven roller disposed in the belt support frame, a driving roller disposed in the belt support frame and engaged with the driven roller to interpose the endless belt therebetween, and an endless belt driving pinion disposed to be exposed outside the belt support frame to drive the driving roller, and the image forming apparatus further comprises a support member to support the polluted member, and a wiper rack which is disposed to the support member to rotate the endless belt driving pinion when the support member moves in the widthwise direction.

14. The image forming apparatus according to claim 12, wherein the wiping unit comprises:

a wiper frame to support the support member;

a guide protrusion which is formed to one of the wiper frame and the support member; and a guide groove which is formed to the other of the wiper frame and the support member, and interlocks with the guide protrusion so that the plurality of wiper members move upwardly from the approaching position to a contact position contacting to an ink discharging surface of the array head unit when the support member moves in the widthwise direction of the printing medium.

15. The image forming apparatus according to claim 12, wherein the scrapping unit moves between a cleaning position cleaning the polluted member, and a second retreating position retreating from the cleaning position, and the image forming apparatus further comprises a scrapping unit driving unit to move the scrapping unit between the cleaning position and the second retreating position.

16. The image forming apparatus according to claim 14, further comprising a control unit to control the widthwise direction driving unit and the wiper elevating unit so that the plurality of wiper members move to the approaching position and the contact position, and move in the widthwise direction of the printing medium and contact the ink discharging surface of the array head unit when a wiping signal is received by the control unit.

17. The image forming apparatus according to claim 15, further comprising:

a control unit to control the scrapping unit driving unit so that the scrapping unit moves to the cleaning position, and to control the wiper elevating unit and the widthwise direction driving unit so that the plurality of wiper members move in the widthwise direction of the printing medium and contact the endless belt of the scrapping unit when a wiper cleaning signal is received by the control unit.

* * * * *